US006220041B1

(12) United States Patent
Okazaki et al.

(10) Patent No.: US 6,220,041 B1
(45) Date of Patent: Apr. 24, 2001

(54) METHOD FOR DETERMINING A CHARGING AMOUNT OF REFRIGERANT FOR AN AIR CONDITIONER, A METHOD FOR CONTROLLING REFRIGERANT FOR AN AIR CONDITIONER AND AN AIR CONDITIONER

(75) Inventors: Takashi Okazaki; Akihiro Matsushita; Yoshihiro Sumida, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/291,952

(22) Filed: Apr. 15, 1999

(30) Foreign Application Priority Data

Jul. 22, 1998 (JP) ..... 10-206166

(51) Int. Cl.[7] ..... F25B 45/00
(52) U.S. Cl. ..... 62/149; 62/77; 62/119
(58) Field of Search ..... 62/149, 77, 119, 62/DIG. 22

(56) References Cited

U.S. PATENT DOCUMENTS

| | | | | |
|---|---|---|---|---|
| 4,484,452 | * | 11/1984 | Houser, Jr. | 62/174 |
| 5,146,761 | * | 9/1992 | Cavanaugh et al. | 62/149 |
| 5,317,903 | * | 6/1994 | McCelland et al. | 62/77 |
| 5,377,493 | * | 1/1995 | Friendland | 62/77 |

FOREIGN PATENT DOCUMENTS

| | | | | |
|---|---|---|---|---|
| 57-92666 | | 6/1982 | (JP) . | |
| 3-244980 | * | 9/1992 | (JP) | 62/149 |
| 4-263753 | * | 9/1992 | (JP) | 62/149 |
| 9-68355 | | 3/1997 | (JP) . | |

* cited by examiner

*Primary Examiner*—William Doerrler
*Assistant Examiner*—Melvin Jones
(74) *Attorney, Agent, or Firm*—Burns, Doane, Swecker & Mathis, LLP

(57) ABSTRACT

An air conditioner capable of conducting a natural circulation operation by circulating refrigerant through an evaporator and a condenser located at a higher position than the evaporator, which are connected with pipes, wherein the air conditioner has means for obtaining an air conditioning load quantity to an outdoor air temperature in a temperature range, means for obtaining an air conditioning ability quantity to an outdoor air temperature in a temperature range in a case of using a predetermined mount of refrigerant, means for obtaining the maximum outdoor air temperature capable of conducting air conditioning at the time when an air conditioning load quantity produced from the means for obtaining an air conditioning load quantity substantially coincides with an air conditioning ability quantity from the means for determining an amount of refrigerant, as an amount to be charged, in which a maximum outdoor air temperature capable of conducting air conditioning among the obtained maximum outdoor air temperatures becomes the maximum.

20 Claims, 16 Drawing Sheets

Δ tc: COMPRESSOR OPERATION TIME Δ tn: COMPRESSOR INACTIVE TIME

METHOD FOR DETERMINING A CHARGING AMOUNT OF REFRIGERANT FOR AN AIR CONDITIONER, A METHOD FOR CONTROLLING REFRIGERANT FOR AN AIR CONDITIONER AND AN AIR CONDITIONER

BACKGROUND OF THE INVENTION

1. Field of the Invention

The present invention relates to an air conditioner operated through the years. In particular, it relates to an improvement of air conditioning ability on an air conditioner capable of conducting a natural circulation operation without using the power of a compressor. Further, the present invention relates to a method for controlling refrigerant for an air conditioner capable of conducting such natural circulation operation as well as a forced circulation operation with the power of a compressor.

2. Discussion of Background

In recent years, a technical field of removing heat from electric machines in a location represented by a computer center or a base station (hereinbelow, referred to as a shelter) accommodating relay electric devices has rapidly spread with spreading of mobile communication such as a portable telephone. Such location is required to conduct an air cooling operation throughout years. In the field of removing from the electric devices requiring an air cooling operation throughout the years, when an outdoor air temperature is low as in a winter season or a night time, it is possible to cool electronic devices by air ventilation. However, a special device for preventing fog, rain, snow, dust and so on from entering therein is necessary. Further, stable air cooling can not be performed because there is variations in an indoor air temperature depending on variations in the outdoor air temperature. Under such conditions, it is possible to use an air conditioner in which natural circulation for carrying heat by refrigerant from an indoor to an outdoor, by utilizing a temperature difference between an indoor air temperature and an outdoor air temperature and a difference of position in height between an indoor unit and an outdoor unit. In the air conditioner utilizing such natural circulation, the power of a compressor is unnecessary when operations utilizing natural circulation (hereinbelow, referred to as natural circulation operation) is to be conducted. Accordingly, it can substantially reduce an annual power consumption in comparison with an air cooling operation by using an air conditioner which conducts operations by using the compressor (hereinbelow, referred to as forced circulation operation).

Now, the operational principle of air cooling operation by the natural circulation will be described with reference to FIG. 17. FIG. 17 is a diagram showing the basic circuit for an air cooling apparatus as an air conditioner utilizing the natural circulation wherein reference numeral 2 designates a condenser, numeral 3 an outdoor fan, numeral 5 an outdoor unit, numeral 6 a liquid pipe, numeral 7 an evaporator, numeral 8 an indoor fan, numeral 9 an indoor unit located in a space to be air-conditioned and numeral 10 a gas pipe. In this case, for conducting air cooling, the evaporator 7 is provided at an indoor side and the condenser 2 is provided at an outdoor side.

The operation will be explained. When the condenser 2 is arranged at a higher position than the evaporator 7, a liquid refrigerant condensed in the condenser 2 descends by the gravity in the liquid pipe 6 to be introduced into the evaporator 7. The liquid refrigerant introduced into the evaporator 7 is vaporized by receiving a thermal load in a space to be air-conditioned, e.g., a room, and then, the vaporized refrigerant ascends in the gas pipe 10 to be returned to the condenser 2; thus, a cycle is formed.

Thus, the air cooling operation by the natural circulation utilizes a density difference between a liquid refrigerant and a gas refrigerant due to a relative position in height between the evaporator 7 and the condenser 2, as a driving force for circulating the refrigerant. The natural circulation can be realized in a case that sum of pressure losses in a refrigerant circuit comprising the condenser 2, the evaporator 7, the liquid pipe 6, the gas pipe 10 and on-off valves in the refrigerant circuit is equal to a pressure increase in the liquid pipe 6 caused by a height of liquid column.

In an air conditioner utilizing such natural circulation, an amount of refrigerant (a refrigerant quantity) to be charged has been determined from experience. Further, a state of the refrigerant has not been properly controlled in consideration of the air conditioning ability during the natural circulation operation.

Further, in an air conditioner utilizing the natural circulation, the existence of a temperature difference between an indoor air temperature and an outdoor air temperature is required. Accordingly, there is a possibility that the natural circulation operation does not function depending on environmental conditions. In this case, an air conditioner capable of effecting the forced circulation operation with use of the compressor in response to the case that the natural circulation operation does not function, is provided. In the air conditioner in combination of the natural circulation operation and the forced circulation operation, it is necessary to provide a refrigerant flow controlling means in the refrigerant circuit from the reasons that there are a variation in a refrigerant flow rate between the natural circulation operation and the forced circulation operation as well as a variation of the refrigerant flow rate due to a variation in the length of a liquid portion, a variation of the refrigerant flow rate derived from a variation of a load, and a difference of a refrigerant quantity derived from the length of the pipes extended in the circuit. In the conventional air conditioners, a reservoir provided at an outlet of the condenser or an accumulator provided at a sucking side of the compressor bore such refrigerant flow controlling function. However, the method for properly controlling a refrigerant quantity has not substantially been conducted.

CONVENTIONAL EXAMPLE 1

FIG. 18 is a diagrammatical view of a conventional air cooling apparatus utilizing natural circuit disclosed in JP-A-9-68355. The operation will be described.

In FIG. 18, reference numeral 1 designates a compressor, numeral 2 a condenser, numeral 3 an outdoor fan, numeral 4 an electronic expansion valve, numeral 5 an outdoor unit, numeral 6 a liquid pipe, numeral 7 an evaporator, numeral 9 an indoor unit, numeral 10 a gas pipe, numeral 11 a check valve, numeral 12 a bypass pipe including the check valve 11 and numeral 14 an accumulator. These structural elements are connected with the liquid pipe 6, the gas pipe 10, the bypass pipe 12 and so on to form a refrigerant circuit.

The outdoor unit comprises the compressor 1 to compress a refrigerant gas, the condenser 2 to liquefy the refrigerant gas, the accumulator 14 for preventing the liquid from returning to the compressor 1 in case such as a transient phenomenon, supercharging of refrigerant and so on, and the bypass pipe 12 including the check valve 11 which bypasses the accumulator. The indoor unit 9 comprises the evaporator 7 and the electronic expansion valve 4 which is provided at a position closest to an inlet of the evaporator.

CONVENTIONAL EXAMPLE 2

FIG. 19 is a diagrammatical view showing the circuit of an air conditioner for controlling a refrigerant quantity in a cooling/warming apparatus capable of conducting the forced circulation operation and the natural circulation operation, disclosed in JP-A-57-92666. In FIG. 19, reference numeral 1 designates a compressor, numeral 2 a condenser, numeral 5 an outdoor unit, numerals 6, 10 designate refrigerant pipes, i.e. a liquid pipe 6 and a gas pipe 10 used for the natural circulation operation, numeral 7 designates an indoor heat exchanger, numeral 9 an indoor unit, numeral 14 an accumulator, numeral 20 a reservoir, numeral 23 a refrigerant flow controlling device, numeral 24 a dryer filter, numeral 25 a heating device, numeral 26 a refrigerant heating coil, numeral 27 an electromagnetic valve, numeral 28 a check valve, numeral 29 a reverse-flow preventing on-off valve for conducting the starting of warming operation smoothly, numeral 30 a high pressure controlling valve for preventing an abnormal increase of pressure or temperature of the refrigerant at an outlet 26*b* of the refrigerant heating coil, numeral 31 a capillary pipe, numeral 32 a partition, numeral 33 a refrigerant pipe, numeral 34 a branch, numeral 35 a pipe, numeral 36 an electric heater, and numerals 37, 38 designate on-off valves.

In the air conditioner, when the forced circulation operation is conducted by using the compressor 1, the electromagnetic valve 27 is closed to form a closed circuit comprising the compressor 1, the condenser 2, the dryer filter 24, the check valve 28, the capillary pipe 31, the refrigerant pipe 6, the indoor heat exchanger 7, the refrigerant pipe 10 and the accumulator 14 of the refrigerant flow controlling device 23 wherein the indoor heat exchanger 7 is operated as an evaporator whereby cooling is effected by utilizing the evaporation of the refrigerant.

On the other hand, in a case of warming by the natural circulation operation, the electromagnetic valve is opened and the heating device 25 is operated to thereby form a closed circuit comprising the refrigerant heating coil 26, and end portion 26*a* at a higher position side of the coil, the electromagnetic valve 27, the accumulator 14, the refrigerant pipe 10, an end portion 7*a* at a higher positional side of the indoor heat exchanger, the indoor heat exchanger 7, an end portion 7*b* at a lower position side of the indoor heat exchanger, the refrigerant pipe 6 and an end portion 26*b* at a low position side of the refrigerant heating coil 6. Then, the indoor heat exchanger 7 is operated as a condenser whereby warming is conducted by utilizing the condensation of the refrigerant.

The inside of the refrigerant flow controlling device 23 is divided to an outside room 20 and an inside room 14 with the partition 32. The outside room 20 influenced by an outdoor air temperature is used as a reservoir and the inside room 14 is as an accumulator. The branch pipe 34 communicates a bottom portion of the reservoir 20 with the refrigerant pipe 33.

The refrigerant pipe 33 connected to the reservoir 20 by means of the branch pipe 34 is a pipe in which a liquid refrigerant of low pressure is passed to the indoor heat exchanger 7 in the forced circulation operation, and it is also a pipe in which the liquid refrigerant after having subjected to heat exchanging in the indoor heat exchanger 7 in the natural circulation operation is passed therethrough.

The accumulator 14 constitutes a refrigerant pipe through which a gas refrigerant after having subjected to heat exchanging in the indoor heat exchanger 7 in the forced circulation operation is passed and a refrigerant pipe through which the gas refrigerant to be supplied to the indoor heat exchanger 7 in the natural circulation operation is passed. A difference in refrigerant quantity between the forced circulation operation and the natural circulation operation is adjusted by the refrigerant flow controlling device 23.

In the above mentioned conventional air conditioners, when an outdoor air temperature is lower than a predetermined value, for example, 5° C. in the natural circulation operation, it is necessary to increase a refrigerant flow rate because an air conditioning load is increased. However, the refrigerant tends to accumulate in the refrigerant controlling device 23 because the refrigerant controlling device 23 is cooled by outdoor air. In such case, the electric heater 36 is actuated to generate heat by an instruction from an outdoor air temperature detecting thermostat that the refrigerant flow controlling device 23 so that the accumulated refrigerant is vaporized. Accordingly, a refrigerant quantity in the refrigerant flow controlling device 23 can properly be maintained even though an outdoor air temperature is low, and a sufficient natural circulation ability can be obtained.

As described above, in the conventional air conditioners utilizing the natural circulation, a refrigerant quantity to be charged was roughly determined without considering the air conditioning ability. Further, there was no attempt to improve the air conditioning ability by controlling a state of the refrigerant in the natural circulation operation.

Further, in the conventional air conditioners capable of effecting the forced circulation operation and the natural circulation operation, when an outdoor air temperature became lower than a set value in a case that the refrigerant quantity in the natural circulation operation was controlled in response to a change of an air conditioning load, the electric heater 36 was made to be conductive by an instruction from the outdoor air temperature detecting thermostat to thereby generate heat whereby a predetermined quantity of heat was given to the refrigerant flow controlling device 23. In the conventional air conditioners, since the control of the refrigerant quantity was not conducted in consideration of how an outdoor air temperature or a refrigerant flow rate influences the ability in the natural circulation operation, there was a problem that an effect of reducing consumption power by utilizing the natural circulation operation became small.

Further, since the adjustment of the refrigerant quantity was conducted by the electric heater, there is substantial power consumed by the electric heater. Further, there was a problem that an effect of reducing consumption power by utilizing the natural circulation operation became small.

SUMMARY OF THE INVENTION

It is an object of the present invention to provide a method for determining a charging amount of refrigerant for an air conditioner utilizing a natural circulation wherein the optimum amount of refrigerant can be charged in consideration of the air conditioning ability while providing the maximum ability of the air conditioner.

Further, it is an object of the present invention to provide a method for controlling refrigerant for an air conditioner capable of conducting a natural circulation operation wherein the optimum state of refrigerant can be provided in consideration of the air conditioning ability while performing the maximum air conditioning ability.

Further, it is an object of the present invention to provide a method for controlling refrigerant for an air conditioner capable of conducting a forced circulation operation and a natural circulation operation wherein the forced circulation operation can smoothly be switched to the natural circulation operation without requiring an external input such as electric heater, and consumption power can substantially be reduced.

Further, it is an object of the present invention to provide a method for controlling refrigerant for an air conditioner capable of conducting a forced circulation operation and a natural circulation operation wherein the forced circulation operation can smoothly be switched to the natural circulation operation without requiring an external input such as an electric heater, the natural circulation operation can be conducted by utilizing the air conditional ability to the maximum, and consumption power can substantially be reduced.

Further, it is an object of the present invention to provide an air conditioner which provides a high air conditioning ability in a natural circulation operation.

In accordance with a first aspect of the present invention, there is provided a method for determining a charging amount of refrigerant for an air conditioner which conducts a natural circulation operation by circulating refrigerant through an evaporator and a condenser located at a higher position than the evaporator, which are connected with pipes, said method being characterized by comprising means for obtaining an air conditioning load quantity to an outdoor air temperature among outdoor air temperatures, means for obtaining an air conditioning ability quantity to an outdoor air temperature in a temperature range in a case of using a predetermined quantity of refrigerant, means for obtaining the maximum outdoor air temperature capable of conducting air conditioning at the time when an air conditioning load quantity produced from the means for obtaining an air conditioning load quantity substantially coincides with an air conditioning ability quantity from the means for obtaining an air conditioning ability quantity in using a predetermined quantity of refrigerant, and means for obtaining respective maximum outdoor air temperatures capable of conducting air conditioning when said predetermined quantity of refrigerant is changed and for determining a refrigerant quantity, as an amount to be charged, in which a maximum outdoor air temperature capable of conducting air conditioning among the obtained maximum outdoor air temperatures becomes the maximum.

In accordance with a second aspect of the present invention, there is provided a method for controlling refrigerant for an air conditioner capable of switching between a forced circulation operation for circulating refrigerant through a compressor, a condenser, a refrigerant flow controlling means, an evaporator and a refrigerant storing means which are connected successively with pipes and a natural circulation operation for circulating the refrigerant through a bypass pipe for bypassing the compressor and the refrigerant storing means, the condenser, the refrigerant flow controlling means and the evaporator which are connected, said method being characterized by comprising at the time of switching from the forced circulation operation to the natural circulation operation, means for making the refrigerant in an outlet portion of the evaporator to be a superheat state, and means for introducing a refrigerant gas in a superheat state into the refrigerant storing means to vaporize the refrigerant stored in the refrigerant storing means whereby the refrigerant stored in the refrigerant storing means during the forced circulation operation is recovered into a refrigerant circuit for the natural circulation operation.

Further, there is provided the method for controlling refrigerant for an air conditioner according to the second aspect, wherein the refrigerant flow controlling means is controlled by said means for making the refrigerant in the outlet portion of the evaporator to be a superheat state so that the refrigerant flow rate is smaller than a refrigerant flow rate in the forced circulation operation.

In accordance with a third aspect of the present invention, there is provided a method for controlling refrigerant for an air conditioner capable of switching between a forced circulation operation for circulating refrigerant through a compressor, a condenser, a refrigerant flow controlling means, an evaporator and a refrigerant storing means which are connected successively with pipes and a natural circulation operation for circulating the refrigerant through a bypass pipe for bypassing the compressor and the refrigerant storing means, the condenser, the refrigerant flow controlling means and the evaporator which are connected, said method being characterized by comprising, at the time of switching from the forced circulation operation to the natural circulation operation, a refrigerant vaporizing means for vaporizing the refrigerant stored in the refrigerant storing means, means for detecting a temperature difference between an outdoor temperature and a set temperature set for air conditioning, and means for changing an evaporation quantity on the refrigerant depending on the magnitude of a temperature difference detected by the temperature difference detecting means in the evaporation of the refrigerant by the refrigerant vaporizing means, whereby a quantity of recovery of the refrigerant stored in the refrigerant storing means in the forced circulation operation is increased or decreased as a result that a refrigerant quantity in the refrigerant circuit in the natural circulation operation is increased or decreased.

In accordance with the present invention, there is provided the method for controlling refrigerant for an air conditioner according to the third aspect wherein a part of a superheated gas discharged from the compressor is introduced into the refrigerant storing means along with the superheated gas from the evaporator by means of a refrigerant vaporizing means on the refrigerant stored in the refrigerant storing means whereby the refrigerant stored in the refrigerant storing means is vaporized.

In accordance with the present invention, there is provided the method for controlling refrigerant for an air conditioner according to the third aspect, wherein the refrigerant vaporizing means is operated for a predetermined time to vaporize the refrigerant stored in the refrigerant storing means.

In accordance with the present invention, there is provided the method for controlling refrigerant for an air conditioner according to the third aspect, wherein the refrigerant vaporizing means is operated on the refrigerant stored in the refrigerant storing means so that a degree of superheating in the outlet portion of the evaporator reaches a predetermined degree of superheating.

In accordance with a fourth aspect of the present invention, there is provided a method for controlling refrigerant for an air conditioner which conducts a natural circulation operation by circulating refrigerant through an evaporator and a condenser located at a higher position than the evaporator, which are connected with a pipe, said method being characterizing in that in the natural circulation operation, at least one of a refrigerant flow rate, an air flow rate to the evaporator and a refrigerant quantity in the evaporator is changed so that a degree of superheating or a degree of dryness of the refrigerant in an outlet portion of the evaporator becomes a predetermined value.

In accordance with the present invention, there is provided the method for controlling refrigerant for an air conditioner according to the fourth aspect, wherein values to be set for the refrigerant in the outlet portion of the evaporator in the natural circulation operation are a value of not less than 0.9 in terms of a degree of dryness and a value of not more than 10° C. in terms of a degree of superheating.

In accordance with the present invention, there is provided the method for controlling refrigerant for an air conditioner according to the fourth aspect, wherein at least one of the refrigerant flow rate, the air flow rate to the condenser and the refrigerant quantity in the condenser is changed so that a degree of supercooling or a degree of dryness of the refrigerant in the outlet portion of the condenser in the natural circulation operation becomes a predetermined value.

In accordance with the present invention, there is provided the method for controlling refrigerant for an air conditioner according to the fourth aspect, wherein values of the refrigerant in the outlet portion of the condenser in the natural circulation operation are not more than 0.1 in terms of a degree of dryness and not more than 20° C. in terms of a degree of supercooling.

In accordance with the present invention, there is provided the method for controlling refrigerant for an air conditioner according to the fourth aspect, wherein at least one of the refrigerant flow rate, the air flow rate and the refrigerant quantity in the natural circulation operation is changed with predetermined time intervals.

In accordance with the present invention, there is provided the method for controlling refrigerant for an air conditioner according to the fourth aspect, wherein at least one of the refrigerant flow rate, the air flow rate and the refrigerant quantity in the natural circulation operation is changed when a temperature difference between an outdoor air temperature and a predetermined set temperature for air conditioning is not more than 25° C.

In accordance with a fifth aspect of the present invention, there is provided an air conditioner comprising an evaporator and a condenser located at a higher position than the evaporator, which is connected to the evaporator with a pipe to conduct a natural circulation operation by circulating refrigerant, said air conditioner being characterized by comprising a refrigerant state detecting means for detecting a state of the refrigerant in an outlet portion of the evaporator in the natural circulation operation, a refrigerant flow controlling means for controlling a refrigerant flow rate in circulation and a controlling means for controlling the refrigerant flow controlling means depending on a state of the refrigerant detected by the refrigerant state detecting means to change the refrigerant flow rate.

In accordance with the present invention, there is provided the air conditioner according to the fifth aspect, which further comprises a refrigerant storing means for storing an excessive amount of the refrigerant resulted from the controlling of the refrigerant flow rate.

In accordance with the present invention, there is provided the air conditioner according to the fifth aspect, wherein the refrigerant state detecting means is to detect a degree of superheating or a degree of dryness of the refrigerant in the outlet portion of the evaporator.

In accordance with the present invention, there is provided the air conditioner according to the fifth aspect, wherein the refrigerant state detecting means is to detect a degree of supercooling or a degree of dryness of the refrigerant in the outlet portion of the condenser, and the controlling means is to operate the refrigerant flow controlling means to change the refrigerant flow rate depending on a temperature difference between an outdoor air temperature and the set temperature set for air conditioning and a state of the refrigerant.

In accordance with a sixth aspect of the present invention, there is provided an air conditioner capable of switching between a forced circulation operation for circulating refrigerant through a compressor, a condenser, a refrigerant flow controlling means, an evaporator and a refrigerant storing means which are connected successively with pipes and a natural circulation operation for circulating the refrigerant through a bypass pipe for bypassing the compressor, the condenser located at a higher position than the evaporator, the refrigerant flow controlling means and the evaporator which are connected, said air conditioner being characterized in that the refrigerant flow controlling means is located in a space where the evaporator is located.

DETAILED DESCRIPTION OF THE PREFERRED EMBODIMENTS

Embodiment 1

Figure 1:
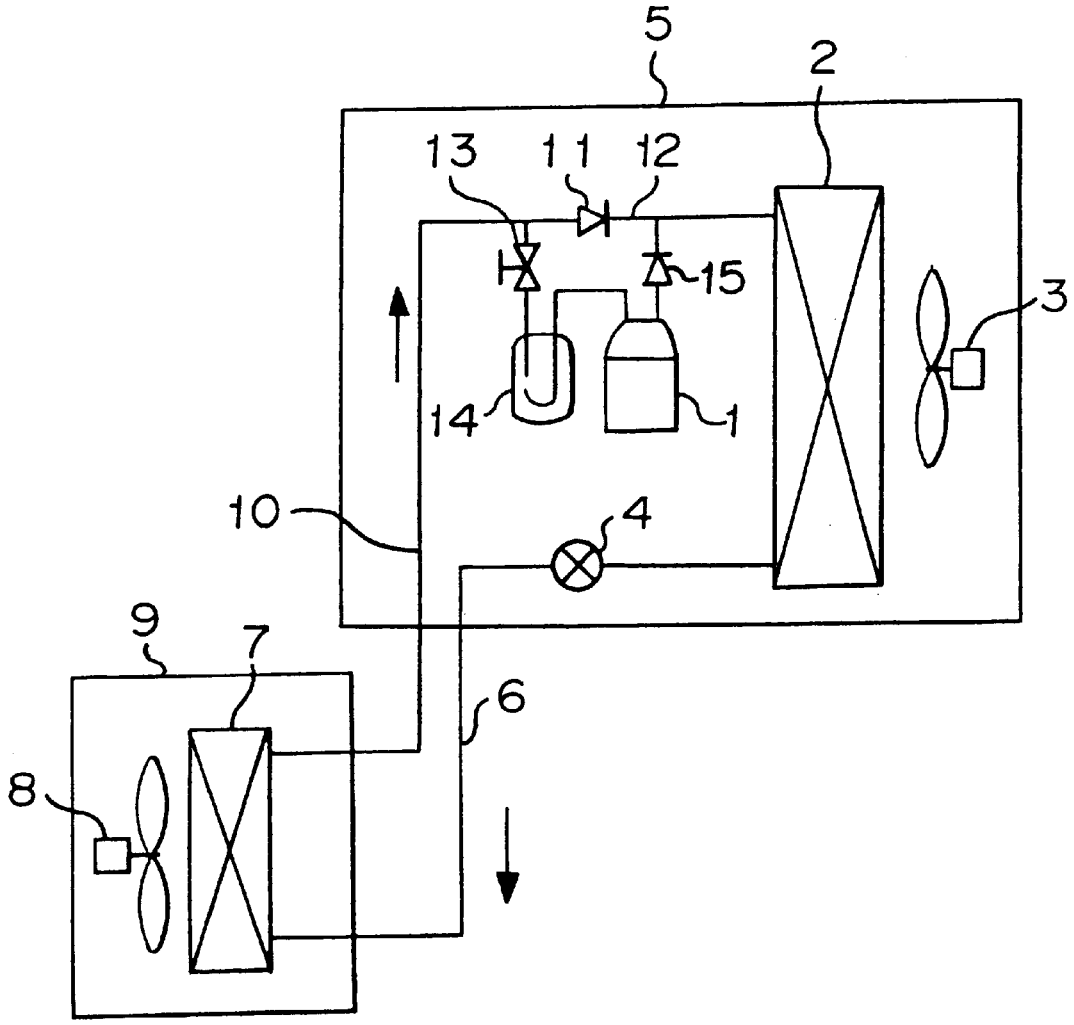
FIG. 1 is a circuit diagram showing the air conditioner according to a first embodiment of the present invention.

In the following, description will be made as to the first embodiment of the present invention with reference to FIG. 1 showing a circuit diagram of an air conditioner such as an air cooling apparatus. The air conditioner is adapted to conduct both a forced circulation operation and a natural circulation operation.

In FIG. 1, reference numeral 1 designates a compressor, numeral 2 a condenser, numeral 3 an outdoor fan, numeral 4 a refrigerant flow controlling means such as an electronic expansion valve, numeral 5 an outdoor unit, numeral 6 a liquid pipe, numeral 7 an evaporator, numeral 8 an indoor fan, numeral 9 an indoor unit, numeral 10 a gas pipe, numeral 11 an on-off means such as a check valve, numeral 12 a bypass pipe, numeral 13 an on-off means such as an on-off valve, numeral 14 an accumulator and numeral 15 an on-off means such as a check valve.

As shown in FIG. 1, a refrigerant circuit is comprised of the outdoor unit 5 and the indoor unit 9 which are connected by means of the liquid pipe 6 and the gas pipe 10, wherein refrigerant is circulated in the circuit.

The outdoor unit 5 comprises the compressor 1 for compressing a refrigerant gas, the condenser 2 for liquefying the refrigerant gas, the outdoor fan 3 as a blower to supply forcibly outer air to an outer surface of the condenser 2, the electronic expansion valve 4 as a refrigerant flow controlling means which conducts pressure reduction of a refrigerant liquid of high temperature and high pressure discharged from the condenser to form a wet vapor in a two-phase state, the accumulator 14 as a refrigerant storing means which prevents the liquid from reversing to the compressor 1 in a transient state or supercharging of the refrigerant, the bypass pipe 12 including the check valve 11 to bypass the compressor 1 and the accumulator 14 in the natural circulation operation, the on-off valve 13 for preventing the refrigerant from entering into the accumulator 14 in the natural circulation operation and the check valve 15 for preventing the refrigerant from entering into the compressor 1 in the natural circulation operation.

The indoor unit 9 comprises the evaporator 7 for vaporizing the wet vapor introduced through the liquid pipe 6 into a refrigerant gas depending on an air conditioning load in a space to be air-conditioned and the indoor fan 8 as a blower to supply forcibly to an outer surface of the evaporator 7.

The condenser 2 of the outdoor unit 5 is located at a higher position than the evaporator 7 of the indoor unit 9, for example, it is located with a positional difference in height of about 1.4 m.

The air conditioner is used in a place where air cooling is required through the years, such as a shelter in which an electric device which generates heat is housed. When an indoor air temperature is lower than an outdoor air temperature, air cooling in the room is conducted by the forced circulation operation in which the compressor 1 is operated. Further, when an indoor air temperature is higher than an outdoor air temperature, the compressor 1 is stopped and air cooling in the room is conducted by the natural circulation operation in which a cold outdoor air is utilized. In the first embodiment, the cooling to a space to be air-conditioned air is conducted by utilizing the refrigerant vaporized in the evaporator 7.

In the following, description will be made as to the forced circulation operation. A degree of opening of the electronic expansion valve 4 is set to an appropriate degree of opening to reduce the pressure of the refrigerant liquid discharged from the condenser 2 to form a wet vapor of two-phase state; the electromagnetic valve 13 at an inlet side of the accumulator 14 is opened, and the compressor 1 is operated. In this case, the check valve 11 is closed due to a pressure difference between a discharge pressure and a suction pressure of the compressor 1. Thus, refrigerant circuit for the forced circulation operation is formed.

Then, description will be made as to the natural circulation operation in a case that an outdoor air temperature is lower than an indoor air temperature.

The compressor 1 is stopped; the electromagnetic valve 13 at an inlet side of the accumulator 14 is closed, and the electronic expansion valve 4 is fully opened to reduce a pressure loss in the refrigerant circuit, for example. In this case, the check valve 11 is opened because of the flow of the refrigerant whereby the refrigerant circuit for the natural circulation operation is formed.

Figure 2:
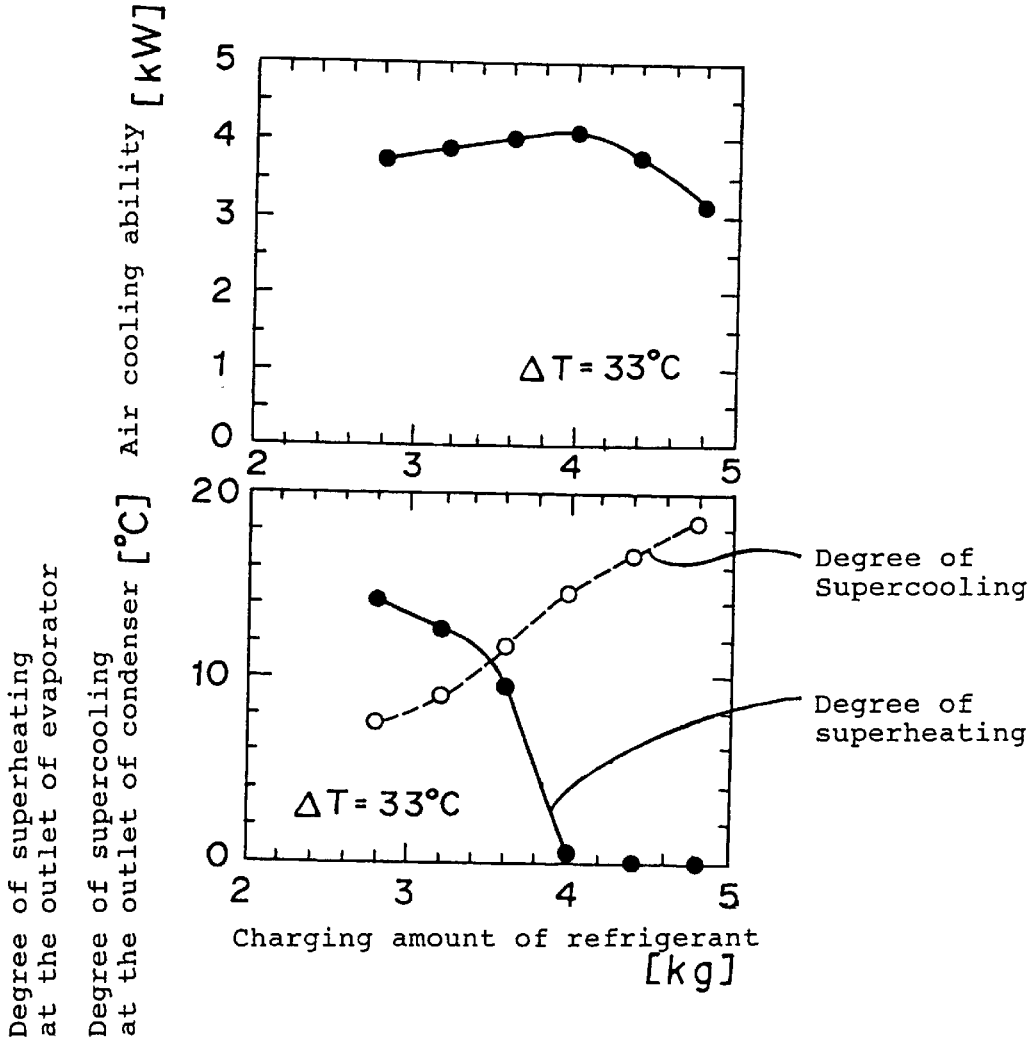
FIG. 2 is a characteristic diagram showing an air cooling ability, a degree of superheating at an outlet of an evaporator and a degree of supercooling at an outlet of a condenser vs a charging amount of refrigerant related to the first embodiment of the present invention.

FIG. 2 shows an experimental result obtained under the conditions as follows. An air conditioner as a test machine capable of conducting the natural circulation operation by circulating refrigerant in a refrigerant circuit comprising the evaporator 8 and the condenser 2 located at a higher position than the evaporator 8, which were connected with a pipe, was prepared. Different amounts of refrigerant (2.8 kg, 3.2 kg, 3.6 kg, 4.0 kg, 4.4 kg and 4.8 kg) were charged and natural circulation operations were conducted to obtain a result of a cooling ability (kW), and a degree of superheating at an outlet of the evaporator (° C.) and a degree of supercooling at an outlet of the condenser (° C.) to each charging amount of refrigerant in the natural circulation operations. An upper graph in FIG. 2 shows a result of the measurement of cooling abilities, and lower graph shows a result of the measurement of degrees of superheating at an outlet of the evaporator (black circles) and degrees of supercooling at an outlet of condenser (white circles). The experiments were conducted under the condition that a temperature difference $\Delta T$ between an indoor air temperature and an outdoor air temperature was 33° C. and constant. The FIG. 2 shows the charging amount of refrigerant in the refrigerant circuit for the natural circulation operation.

As is understood from the upper graph of FIG. 2 showing the air cooling ability, the cooling ability exhibits the maximum value with a charging amount of refrigerant of 4 kg or its vicinity. The reason why the air cooling ability increases with an increase of the charging amount of refrigerant in a case that the charging amount of refrigerant is less than 4 kg is that an effective height of liquid column in the refrigerant circuit is increased with an increase of the charging amount of refrigerant so that the refrigerant flow rate is increased. Further, the reason why the air cooling ability is decreased with an increase of the charging amount of refrigerant in a case that the charging amount of refrigerant exceeds 4 kg is that an enthalpy difference in the evaporator is decreased because the refrigerant at the outlet of the evaporator becomes a two-phase state, and a pressure loss in the gas pipe extended from the outlet of the evaporator to the inlet of the condenser is increased whereby the refrigerant flow rate is decreased.

Further, as is understood from the lower graph of FIG. 2 showing the degree of superheating at the outlet of the evaporator, the refrigerant at the outlet of the evaporator becomes a saturated gas state (a degree of superheating at the outlet of the evaporator of 0° C.) in the charging amount of refrigerant in which the air cooling ability becomes the maximum (a charging amount of refrigerant of around 4 kg in the upper graph of FIG. 2). Accordingly, when the charging amount of refrigerant is determined to a value around 4 kg at the temperature difference of 33° C. between the outdoor and the indoor in this case, the cooling ability in the natural circuit operation can be utilized to the maximum and the maximum effect of reducing consumption power can be obtained. Further, since the rate of reduction of the cooling ability in using a refrigerant amount of 4 kg or more is larger than that of a case of using an amount of 4 kg or lower, a nearly maximum cooling ability can be obtained when the amount of the refrigerant to be charged is not more than the charging amount where the cooling ability becomes the maximum, for example, 3.5 kg–4.0 kg.

Further, as shown in FIG. 2, an appropriate charging amount of refrigerant in the forced circulation operation under experimental conditions is about 2 kg. In this case, it is understood that a charging amount of refrigerant of about 2 times (4 kg/2 kg) in the forced circulation operation should be charged in order to obtain the maximum cooling ability in the natural circulation operation.

Figure 3:
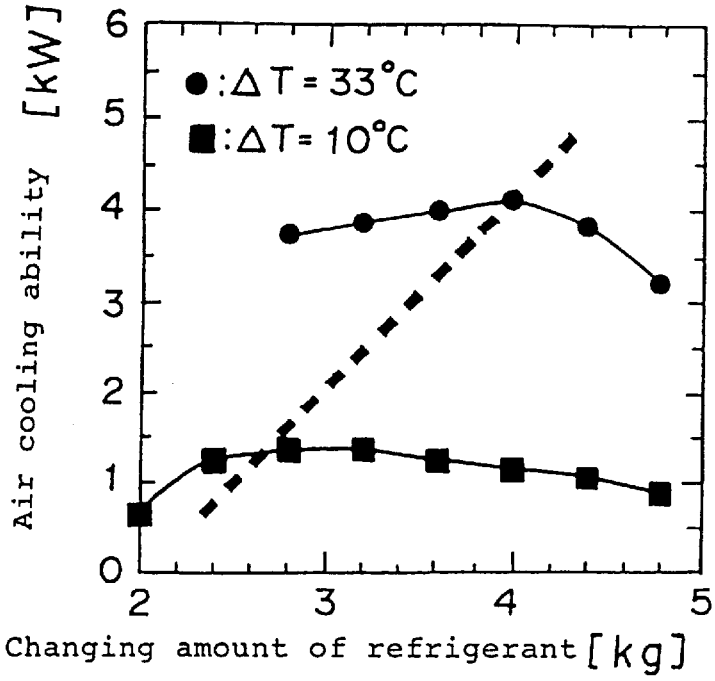
FIG. 3 is a characteristic diagram showing an air cooling ability vs a charging amount of refrigerant related to the first embodiment of the present invention.

FIG. 3 is a graph showing relations of a charging amount of refrigerant (kg) in the natural circulation operation to a cooling ability (kW) in cases of temperature difference T of 33° C. and 10° C. between an indoor air temperature and an outdoor air temperature. As shown in FIG. 3, when the temperature difference ΔT between an indoor air temperature and an outdoor air temperature becomes small, the charging amount of refrigerant in which the maximum cooling ability can be obtained is reduced. A dotted line in FIG. 3 is a linear line connecting maximum values of the cooling ability in response to a change of the temperature difference. This is derived from the fact that when the temperature difference ΔT becomes small, the degree of supercooling at an outlet of condenser is decreased whereby an effective height of liquid column in the refrigerant circuit is decreased and the refrigerant flow rate is decreased. From this fact, it is understood that when there is a small temperature difference between the indoor and the outdoor because of, for instance, outdoor temperature being higher, a smaller charging amount of refrigerant provides a higher cooling ability in comparison with a case that the temperature difference is large.

Figure 4:
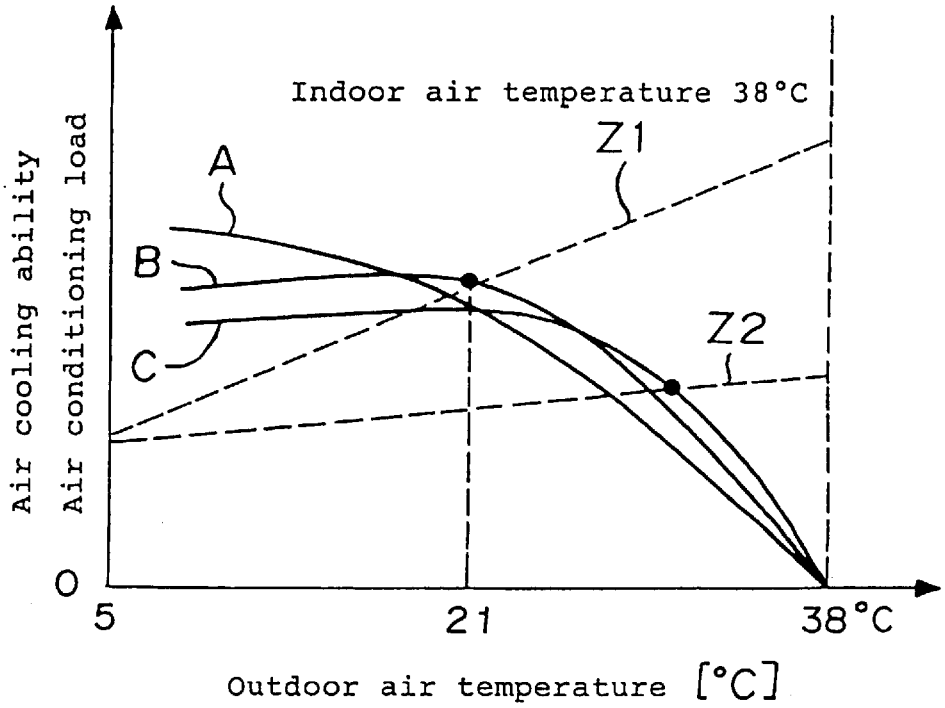
FIG. 4 is a characteristic diagram showing a relation between an outdoor air temperature and an air conditioning load and an air cooling ability related to the first embodiment of the present invention.
Figure 5:
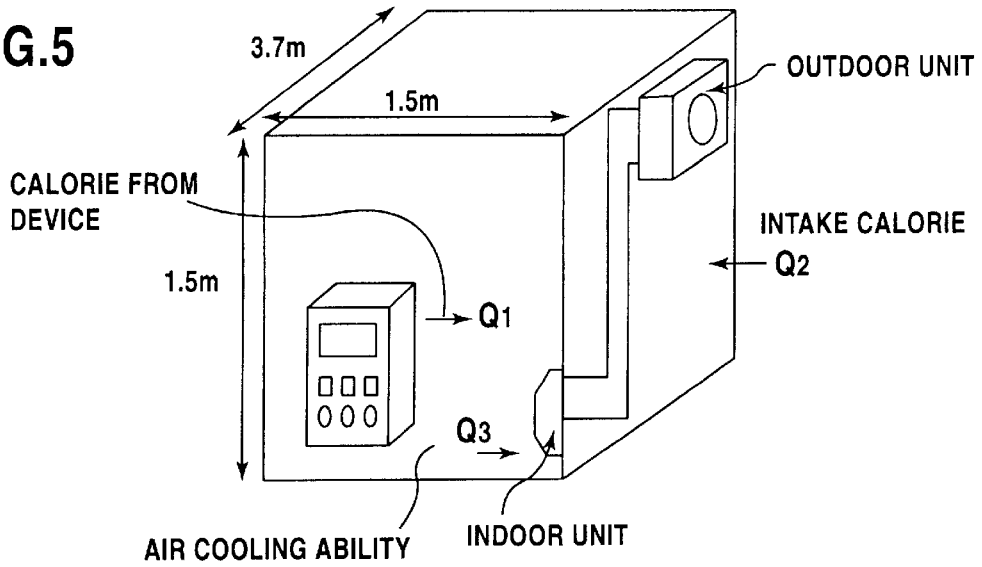
FIG. 5 is a diagram showing a simulation model related to the first embodiment of the present invention.

FIG. 4 is a graph showing a relation between an outdoor air temperature and a cooling ability (an air conditioning load) in the natural circulation operation in a case of an indoor air temperature of 38° C. In FIG. 4, the abscissor represents an outdoor air temperature (° C.); the ordinate represents a cooling ability and an air condition load; a curve A indicates an air conditioning ability quantity to an outdoor air temperature in a temperature range when a charging amount of refrigerant of 4 kg is used; a curve B indicates an air conditioning ability quantity to an outdoor air temperature in the temperature range when a charging amount of refrigerant of 3.5 kg is used, and a curve C indicates an air conditioning ability quantity to an outdoor air temperature in the temperature range when a charging amount of refrigerant of 3.0 kg is used. These air conditioning ability quantities can be obtained by simulation or experiment using a device constituting an air conditioner.

Further, in FIG. 4, dotted linear lines Z1 or Z2 indicates air conditioning load quantity to an outdoor air temperature in a temperature range when an indoor air temperature of 38° C. is determined.

The air conditioning load quantity to an outdoor air temperature in several outdoor air temperatures can be obtained based on a heat value of the device, a thermal capacity of the shelter, and a heat value absorbed to or radiated from the wall in a designing step.

In a case that an electric device is used in a space such as a shelter where a man seldom comes in or goes out, and there is no substantial change of heat value per unit time from the electric device such as the air conditioner according to the first embodiment, the air conditioning load quantity becomes large as the outdoor air temperature becomes high, and the air conditioning load quantity simply increases as indicated by linear lines Z1, Z2.

The air conditioning ability quantity, (i.e., the cooling ability quantity in this case) in the natural circulation operation is zero when the outdoor air temperature is 38° C. which is the same as the indoor temperature of 38° C., and the air conditioning ability quantity will increase as the outdoor air temperature decreases from 38° C. On the contrary, the air conditioning load decreases as the outdoor air temperature decreases because there is heat radiation from the indoor to the outdoor. For example, assuming that an air conditioning load line under a condition that the inside of the shelter is kept at 38° C. or lower takes Z1. In this case, the outdoor air temperature at which the cooling ability quantity is substantially in agreement with the air conditioning load quantity, namely, the outdoor air temperature at a crossing point of the cooling ability curve and the air conditioning load line Z1 is the maximum outdoor air temperature capable of conducting air conditioning at which the natural circulation operation can cover the air conditioning load. In more detail, when the charging amount of refrigerant indicated by the cooling ability curve B is used, the curve B intersects the air conditioning load line Z1 at an outdoor air temperature 21° C., and therefore, the maximum outdoor air temperature capable of conducting air conditioning is 21° C. In this case, the cooling ability in the natural circulation operation is larger than or equal to the air conditioning load even at any outdoor air temperature of the maximum outdoor air temperature capable of air conditioning of 21° C. or lower. Accordingly, the cooling ability in the natural circulation operation is enough to cover the air conditioning load.

Thus, the maximum outdoor air temperature capable of conducting air conditioning at which the above-mentioned air conditioning ability quantity and the above-mentioned air conditioning load quantity substantially coincide is obtained in the respective charging amounts of refrigerant.

In the first embodiment, in order to utilize at the maximum the air conditioning ability of the air conditioner in the natural circulation operation, the refrigerant is charged in the refrigerant circuit so that the maximum outdoor air temperature capable of conducting air conditioning has the highest value. Namely, assuming that the air conditioning load quantity is indicated by the linear line Z1 in FIG. 4, three curves A, B and C intersects the linear line Z1. Among the intersecting points, the charging amount of refrigerant of a cooling ability curve which shows the highest outdoor air temperature is selected. Then, there is obtainable a large temperature range wherein the air cooling ability in the natural circulation operation can sufficiently cover the air conditioning load quantity. In FIG. 4, the maximum outdoor air temperature capable of conducting air conditioning at the point of intersection of the curve B and linear line Z1 is the highest. Accordingly, a refrigerant amount of 3.5 kg corresponding to the curve B is the best. Thus, by determining the refrigerant amount to be charged in the refrigerant circuit, a range of the outdoor air temperature wherein the air conditioning load quantity is covered by the natural circulation operation is the broadest, whereby the maximum effect of reducing consumption power can be obtained.

The charging amount of refrigerant determined as described above varies depending on a change of the air conditioning load quantity. For example, in a case of the air conditioning load quantity indicated by the linear line Z2, the maximum outdoor air temperature capable of conducting air conditioning at the point of intersection of the curve C and the linear line Z2 shows the highest value. When the refrigerant amount of 3 kg corresponding to the curve C is determined as a charging amount of refrigerant, the outdoor air temperature range capable of covering the air conditioning load quantity in the natural circulation operation becomes the maximum.

In a range higher than the outdoor air temperature at the point of the intersection of the air conditioning ability curve and the air conditioning load linear line, it is impossible to cover the air conditioning load quantity by the natural circulation operation. Accordingly, the forced circulation operation is used when the outdoor air temperature exceeds the value.

On the other hand, when the outdoor air temperature is lower than the maximum outdoor temperature capable of conducting air conditioning and if the outdoor air temperature eventually increases to exceed the maximum outdoor air temperature whereby the air conditioning load is increased, the degree of opening of the electronic expansion valve 4 may be changed so that the degree of superheating of the refrigerant in an outlet portion of the evaporator 7 is controlled to nearly 0, for example. As shown in FIG. 2, the cooling ability is the maximum when a state of the refrigerant in the outlet portion of the evaporator is nearly 0° C. in terms of a degree of superheating. In this case, when the operation is conducted so that the degree of superheating of the refrigerant in the outlet portion of the evaporator 7 takes a value of nearly 0° C., it is possible to increase the air cooling ability in comparison with the case that the present condition is continued.

Further, it is unnecessary to use the forced circulation operation in a case that the outdoor air temperature does not exceed a temperature at which the air conditioning load can be covered by only the natural circulation operation. In this case, the refrigerant circuit for the natural circulation operation is used, and a refrigerant quantity wherein a temperature range in which the air conditioning load quantity can be covered by the natural circulation operation is the maximum is charged as described above.

In the air conditioner utilizing the natural circulation operation, only the outdoor fan 3 and the indoor fan 8 are required as power for the operation, and accordingly, annual consumption power can substantially be reduced. In particular, in the first embodiment, since the charging amount is determined so that there is obtainable a large range of outdoor air temperature capable of air conditioning in the natural circulation operation, the annual consumption power can further be reduced.

For example, a shelter model of 1.5 m wide, 3.7 m deep and 1.5 m high was prepared wherein Q1 represents a calorific power from the device, Q2 represents heat absorbed to or emitted from the wall, Q3 represents a cooling ability quantity of the indoor unit, Q3*c* represents a cooling ability quantity of the indoor unit in the forced circulation operation, and Q3*n* represents a cooling ability quantity of the indoor unit in the natural circulation operation. Simulation of temperature change in the shelter which was subject to air conditioning was conducted. A set temperature range in air conditioning in the shelter was determined to be 26° C.–38° C. and an outdoor air temperature is to be 26° C.

Figure 6A:
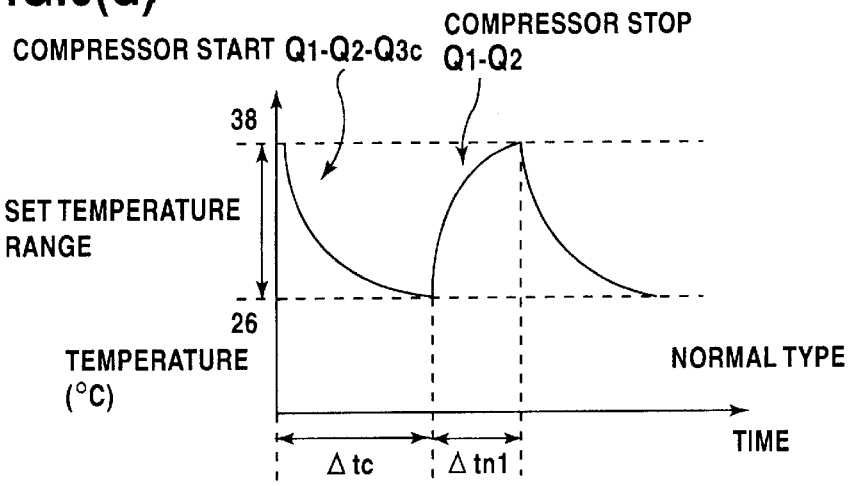
FIGS. 6*a* and 6*b* are graphs showing changes of temperature to time as a result of simulation related to the first embodiment of the present invention.
Figure 6B:
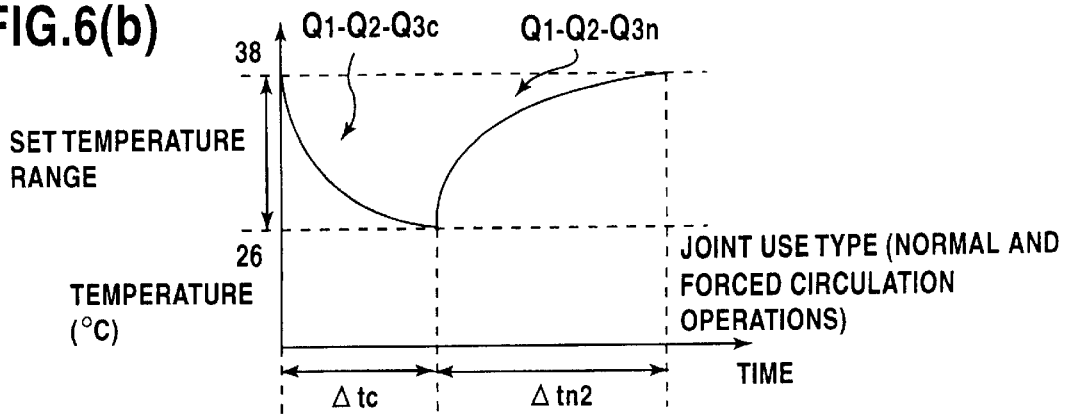

FIGS. 6*a* and 6*b* show changes of temperature in the shelter with time. FIG. 6*a* shows a change of temperature in a case that air conditioning is conducted by only the forced circulation operation with the compressor (usual type), and FIG. 6*b* shows a change of temperature in a case that the natural circulation operation and the forced circulation operation are used together (cooperation type). When a temperature in the shelter becomes 38° C. (as an upper limit of the set temperature range) or higher, the compressor is operated to conduct cooling operation by the forced circulation operation. Further, when the temperature in the shelter becomes 26° C. (as a lower limit of the set temperature range) or less, the compressor is stopped to stop the cooling operation (FIG. 6*a*) and the compressor is stopped to conduct the cooling by the natural circulation operation (FIG. 6*b*). In this cooperation type, the maximum outdoor air temperature capable of conducting air conditioning by the natural circulation operation is to be 26° C. or lower.

The inside of the shelter is cooled with a heat quantity of Q1-Q2-Q3*c* by the forced circulation operation so that it is cooled from 38° C. to 26° C. in Δtc (time). In the usual type in FIG. 6*a*, when the operation of the compressor is stopped, the temperature is gradually increased with a heat quantity of Q1-Q2. Then, when the temperature reaches the upper limit of the temperature range in Δtn1 (time), the compressor is again operated. On the other hand, in the cooperation type in FIG. 6*b*, when the operation of the compressor is stopped, the air cooling operation is conducted by the natural circulation operation. Accordingly, the temperature is gradually increased with a heat quantity of Q1-Q2-Q3*n*. Then, it reaches the upper limit of the set temperature range in Δtn2 (time) which is longer than Δtn1 (time), and the compressor is again operated.

Thus, with the cooperation of the forced circulation operation and the natural circulation operation, it is possible to elongate a time in which the compressor is stopped, and operating efficiency of the compressor is decreased from Δtc/(Δtc+Δtn1) to Δtc/(Δtc+Δtn2).

A result of the simulation reveals that the air conditioner of cooperation type can reduce the annual operating efficiency of the compressor to about 69–86% in comparison with the air conditioner utilizing only the forced circulation operation. Further, the number of stopping of the compressor can remarkably be decreased and reliability is increased.

Further, the reduction of the operation time of the compressor results the reduction the annual consumption power of about 51–66%. In particular, in the air conditioner according to the first embodiment wherein a charging amount of refrigerant which allows the cooling ability by the natural circulation operation to be the maximum, the above-mentioned effect can certainly be obtained.

Embodiment 2

Figure 7:
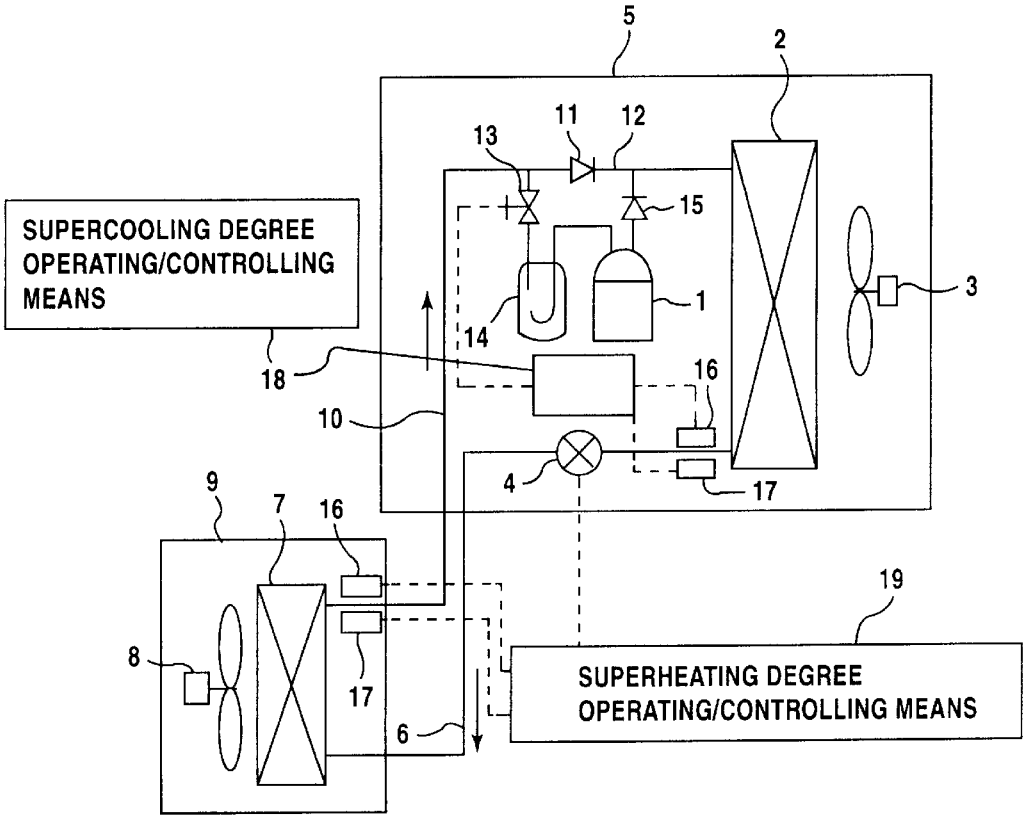
FIG. 7 is a circuit diagram showing the air conditioner according to a second embodiment of the present invention.

An air cooling apparatus is exemplified as the air conditioner according to the second embodiment of the present invention. FIG. 7 is a circuit diagram of the air conditioner according to the second embodiment.

In FIG. 7, reference numerals 16 designate temperature directing means such as temperature sensors, numerals 17 designate pressure detecting means such as pressure sensors, numeral 18 designates a supercooling degree operating/controlling means to operate a degree of supercooling of refrigerant in an outlet portion of the condenser 2 to control it to be a predetermined value, and numeral 19 designates a superheating degree operating/controlling means to operate a degree of superheating of the refrigerant in the outlet portion of the evaporator 7 to control it to be a predetermined value. The supercooling degree operating/controlling means 18 and the superheating degree operating/controlling means 19 are respectively provided with a refrigerant state detecting function and a controlling function to properly controlling the refrigerant state detected. The same reference numerals as in FIG. 1 designate the same or corresponding parts.

The air conditioner of the second embodiment is constituted by the outdoor unit 5, the indoor unit 9 and the liquid type 6 and the gas pipe 10 which connect the outdoor unit 5 and the indoor unit 9 in the same manner as the first embodiment.

The outdoor unit 5 comprises the compressor 1 for compressing a refrigerant gas, the condenser 2 for liquefying the refrigerant gas, the outdoor fan 3, as a blower, to supply forcibly outer air to an outer surface of the condenser 2, the electronic expansion valve 4, as a refrigerant flow controlling means, which conducts pressure reduction of the refrigerant of high temperature and high pressure discharged from the condenser 2 to form a wet vapor in a two-phase state, the accumulator 14 as a refrigerant storing means which prevents the liquid from reversing to the compressor 1 in a transient phenomenon or the supercharging of the refrigerant, the bypass pipe 12 including a check valve 11 to bypass the compressor 1 and the accumulator 14 in the natural circulation operation, the check value 11 as an on-off means for opening or closing the accumulator 12 to the refrigerant circuit, the on-off valve 13 for preventing the refrigerant from entering into the accumulator 14 in the natural circulation operation and the check valve 15 as an on-off means for preventing the refrigerant from entering into the compressor 1 in the natural circulation operation.

The indoor unit 9 comprises the evaporator 7 for vaporizing the wet vapor introduced through the liquid pipe 6 into a refrigerant gas depending on an air conditioning load in a space to be air-conditioned, and the indoor fan 8 as a blower to supply outdoor air forcibly to a outer surface of the evaporator 7.

In this air conditioner, the forced circulation operation is conducted when an outer air temperature is higher an indoor air temperature. Namely, the degree of opening of the electronic expansion valve 4 is set to an appropriate degree of opening so that the pressure of the refrigerant liquid discharged from the condenser 2 is reduced to form a wet vapor in a two-phase state; the electromagnetic valve 13 at an inlet side of the accumulator 14 is opened, and the compressor 1 is operated. At this moment, the check valve 11 is closed because of a pressure difference between a discharge pressure and an intake pressure of the compressor 1, whereby the refrigerant circuit for the forced c-circulation operation is formed.

Further, when an outer air temperature is lower than an indoor air temperature, the degree of opening of the electronic expansion valve 4 is fully opened to reduce a pressure loss in the refrigerant circuit and the electromagnetic valve 13 at an inlet side of the accumulator 14 is closed. At this moment, the check valve 11 is opened by the flow of the refrigerant, whereby the refrigerant circuit for the natural circulation operation is formed.

As mentioned in the first embodiment, in order to make the air cooling ability in the natural circulation operation to be the maximum, it is necessary for the forced circulation operation to supply a charging amount of the refrigerant as about twice as that in the natural circulation operation due to a difference in a refrigerant flow rate or a length of the liquid portion. Accordingly, the air conditioner should have such a structure that an excessive amount of refrigerant liquid is stored in the accumulator 14 as a refrigerant storing means in the forced circulation operation. Then, at the time of switching to the natural circulation operation, the excessive refrigerant stored in the accumulator 14 is returned to the refrigerant circuit for the natural circulation operation, i.e., a refrigerant recovering operation is conducted.

As a method for recovering the refrigerant, the degree of opening of the electronic expansion valve 4 is made smaller than that in the forced circulation operation or the valve is fully opened to throttle the refrigerant flow rate to be smaller or zero, and the compressor 1 is operated for a predetermined time. At the moment, the refrigerant in an outlet portion of the evaporator 7 becomes a state of superheating to produce a superheat gas. The excessive refrigerant stored in the accumulator 14 is vaporized by the superheat gas and the vaporized refrigerant is introduced into the condenser 2 through the check valve 15. Such refrigerant recovering operation is conducted for a predetermined time, e.g., about 2 minutes. After the refrigerant recovering operation is finished, the compressor 1 is stopped. Then, the electromagnetic valve 13 at an inlet side of the accumulator 14 is closed to prevent the refrigerant from entering into the accumulator 14 which is in a state of low temperature and low pressure at the time of switching the operation to the natural circulation operation. In this embodiment, a time necessary to evaporate the excessive refrigerant stored in the accumulator 14 is previously obtained and the refrigerant recovering operation is conducted in the previously obtained time. However, means for detecting the temperature of the refrigerant at a discharge side and an intake side of the compressor 1 may be provided, and the refrigerant recovering operation may be finished depending on set values.

In the following, description will be made as to a method for controlling a refrigerant state in the natural circulation operation.

As shown in FIG. 2, in the state where the cooling ability becomes the maximum in the natural circulation operation, the degree of superheating (indicated by a black circle) at an outlet of the evaporator 7 is 0° C. This phenomenon is utilized. For example, a degree of superheating of 5° C. which is near 0° C. is taken as a set value. Then, when the degree of superheating at the outlet of the evaporator 7 is controlled to such set value of superheating, it is possible to operate the air conditioner in a state around which the cooling ability becomes the maximum. In this case, when the degree of superheating at the outlet of the evaporator 7 takes a positive value, a detection value on the degree of superheating changes in response to a change of a state of the refrigerant. However, when the detection value on the superheating is 0° C., it shows a saturated gas temperature whereby the detection value of the superheating is 0° C. regardless of a state of the refrigerant, and the detection value does not show a value lower than 0° C. Accordingly, it is preferred that the set value is a positive value near 0° C., for example, 5° C. other than 0° C.

In fact, in the air conditioner according to the second embodiment, when the natural circulation operation is conducted, the degree of superheating at the outlet of the evaporator 7 is controlled by changing the degree of opening of the electronic expansion valve 4 as a refrigerant flow controlling means to thereby change a refrigerant flow rate.

In the following, the controlling method is described. The degree of superheating at the outlet of the evaporator 7 is operated by the superheating degree operating/controlling means 19 based on values detected by the temperature sensor 16 and the pressure sensor 17 located in the outlet portion of the evaporator 7. The degree of superheating can be operated according to a superheating degree calculating formula (1) described below.

$$\text{Degree of superheating (° C.)} = \text{Detected value of temperature} - \text{Saturated temperature based on detected value of pressure} \quad (1)$$

Then, the calculated value of superheating degree and a set value of superheating degree (for example, about 5° C.) are compared, and the degree of opening of the electronic expansion valve 4 is operated based on a difference between the compared values. Then, the degree of opening of the electronic expansion valve 4 is set to the degree of opening obtained by the calculation whereby the refrigerant flow rate is changed. For instance, when the detected value of the superheating degree is larger than the set value of superheating degree, the degree of opening of the electronic expansion valve 4 is made large to increase the refrigerant flow rate whereby the degree of superheating is lowered. On the contrary, when the detected value of superheating degree is smaller than the set value of superheating degree, the degree of opening is made small to reduce the refrigerant flow rate whereby the degree of superheating is increased. When such processes are repeated with predetermined intervals, e.g. intervals of about 5 minutes, the refrigerant flow rate can be changed whereby the degree of superheating in the outlet portion of the evaporator 7 is controlled to become the set value. Thus, the natural circulation operation can be conducted so that the air conditioning ability is usually at or around the maximum.

Particularly, since the flow rate of the refrigerant in the natural circulation operation is smaller than that in the forced circulation operation, the electronic expansion valve 4 should be controlled with predetermined time intervals, e.g., time intervals of about 5 minutes to change the refrigerant flow rate. This allows the control at a rate suited for the movement of the refrigerant. Accordingly, the natural circulation operation can stably be conducted. The time intervals may be longer than 5 minutes, for example, it is about 10 minutes.

Further, when an outdoor air temperature is high and a temperature difference between the outdoor air temperature and a set temperature for air conditioning for the room is small, a refrigerant quantity which provides the maximum air cooling ability is small as shown in FIG. 3. Accordingly, by changing the refrigerant flow rate so that a degree of superheating in the outlet portion of the evaporator 7 becomes a set value (for example, about 5° C. in superheating degree), a distribution of the refrigerant quantity in the refrigerant circuit is changed, an excessive refrigerant is accumulated in the outlet portion of the condenser 2 whereby the degree of supercooling of the refrigerant at the outlet of the condenser 2 is increased. Thus, when the degree of supercooling of the refrigerant in the outlet portion of the condenser 2 is increased, a surface area for the condensation in the condenser 2 becomes small whereby efficiency in the natural circulation operation becomes poor.

In the second embodiment, accordingly, the electromagnetic valve is controlled so that a refrigerant state in the outlet portion of the condenser 2 has a predetermined set value. For example, the refrigerant flow rate is changed so that a degree of superheating in the outlet portion of the evaporator 7 becomes a set value in superheating degree, and at the same time, the refrigerant quantity in the condenser 2 is changed so that the degree of supercooling in the outlet portion of the condenser 2 becomes a set value in supercooling degree. Namely, the degree of supercooling of the refrigerant in the outlet portion of the condenser 2 is calculated by the supercooling degree operating/controlling means 18 based on values detected by the temperature sensor 16 and the pressure sensor 17 located at the outlet portion of the condenser 2. The degree of supercooling can be obtained by the supercooling degree calculating formula (2) as follows.

$$\text{Degree of supercooling (° C.)} = \text{Saturated temperature based on detected value of pressure} - \text{Detected value of temperature} \quad (2)$$

Then, the detected value in supercooling degree calculated and the set value in supercooling degree (for example, about 8° C. in supercooling degree) are compared. When the detected value in supercooling degree calculated exceeds a certain value with respect to the set value in supercooling degree, the electromagnetic valve 13 located at the inlet side of the accumulator 14 is opened for a predetermined time, e.g., about 10 seconds. Accordingly, excessive refrigerant flowing in the gas pipe 10 flows into the accumulator 14 which is in a state of low temperature and low pressure. When the electromagnetic valve 13 is again closed, the refrigerant quantity in the refrigerant circuit in the natural circulation operation is reduced and the refrigerant quantity in the condenser is also reduced. Accordingly, the degree of supercooling of the refrigerant in the outlet portion of the condenser 2 becomes small. Thus, the degree of supercooling at the outlet of the condenser 2 can be controlled to a set value, and the state of the refrigerant in the outlet portion of evaporator 7 and the condenser 2 can be followed to a condition which renders the cooling ability to be the maximum.

In this case, the excessive refrigerant in the accumulator 14 resulted from the control of the refrigerant quantity by the supercooling degree operating/controlling means 18 is not circulated in the refrigerant circuit during the natural circulation operation. However, it can be returned to the refrigerant circuit by the forced circulation operation with the operation of the compressor 1 and the refrigerant recovering operation.

As described above, the air conditioner according to the second embodiment utilizes the phenomenon that in the natural circulation operation, the air conditioning ability becomes the maximum when the degree of superheating of the refrigerant in the outlet portion of the evaporator 7. In the second embodiment, control is conducted so that the degree of superheating at the outlet of the evaporator 7 becomes a set value in superheating degree (for example, about 5° C. in superheating degree) based on such phenomenon, whereby the air conditioner can provide the maximum air conditioning ability in the natural circulation operation without detecting an outdoor air temperature.

Further, in accordance with the second embodiment, the reduction of efficiency caused by controlling the refrigerant state in the outlet portion of the evaporator 7 can be prevented. For this, control is so made that the refrigerant state in the outlet portion of the condenser 2 becomes a set value (for example, about 8° C. in supercooling degree). Thus, by controlling the refrigerant state in the outlet portion of the evaporator 7 and the condenser 2, a method for controlling the refrigerant so that the air conditioning ability in the natural circulation operation becomes the maximum, can be obtained. For example, there is a way to store in the accumulator 14 as a refrigerant storing means an excessive amount of refrigerant, which is resulted by changing the refrigerant flow rate, in the condenser 2. In this case, even when the temperature difference between an outdoor air temperature and an indoor air temperature is small, the reduction of the surface area for the condensation in the condenser 2 is prevented whereby the deterioration of the efficiency in the natural circulation operation can be prevented.

Further, in controlling the refrigerant state in the outlet portion of the condenser 2 to be a predetermined degree of supercooling, an excessive amount of refrigerant is stored in the refrigerant storing means, i.e., the accumulator 14, which is always required for the forced circulation operation, so that the refrigerant quantity in the condenser 2 is changed. This permits the control of the refrigerant quantity without requiring a special device, and the air conditioning ability can be utilized to the maximum in the natural circulation operation.

Further, since the adjustment of the refrigerant quantity is conducted by the accumulator 14, the electromagnetic valve 13 and the electronic expansion valve 4 without using any external device such as an electric heater, a large effect of reducing consumption power as an advantage of the natural circulation operation can be obtained.

In the construction shown in FIG. 7, the refrigerant state in the outlet portion of the condenser 2 is controlled along with the control of the refrigerant state in the outlet portion of the evaporator 7. This is, in particular, for the purpose that the excessive refrigerant caused by changing the refrigerant flow rate by the superheating degree operating/controlling means 19 does not adversely affect the natural circulation operation. When the temperature difference between an outdoor temperature and a set temperature for air conditioning in the room is large, it is unnecessary to reduce substantially the refrigerant flow rate, and accordingly, a reduction on the efficiency due to an increase of the degree of supercooling in the outlet portion of the condenser 2 is not so large. Accordingly, the control of the degree of supercooling by the supercooling degree operating/controlling means 18 is not in particular required, and the supercooling degree operating/controlling means 18 and the temperature sensor 18 and the pressure sensor 17 used in association therewith can be eliminated.

Further, since we have a higher outdoor air temperature in a summer season and an effective refrigerant quantity in the refrigerant circuit is preferred to be small, an excessive amount of refrigerant is to be stored in the accumulator 14 by means of the supercooling degree operating/controlling means 18. On the other hand, since we have a lower outside air temperature in a winter season and an excessive amount of refrigerant is not so much, control for storing the refrigerant in the accumulator 14 is not conducted.

Further, since the supercooling degree operating/controlling means 18 and the superheating degree operating/controlling means 19 can be realized by microcomputer software respectively, microcomputers may be housed in an electrical box for the outdoor unit 5 or the indoor unit 9 to execute the software.

Target values for control on the refrigerant state in the outlet portion of the evaporator 7 by means of the superheating degree operating/controlling means 19 are such values: a degree of dryness X of not less than 0.9 and a degree of superheating of not more than 10° C. The reason of determining a lower limit value of 0.9 in terms of a degree of dryness in the outlet portion of the evaporator 7 is that when the degree of dryness in the outlet portion of the evaporator 7 is less than 0.9, a pressure loss in the gas pipe 10 becomes large and therefore, the natural circulation operation can not effectively performed. Further, when the degree of superheating in the outlet portion of the evaporator 7 is larger than 10° C., a superheating region in the evaporator 7 is increased so that the heat transfer surface area effective for the evaporation is decreased.

Further, it is desirable that the target values in terms of a degree of supercooling in the outlet portion of the condenser 2 by means of the supercooling degree controlling means 18 are a degree of dryness of not more than 0.1 and a degree of supercooling of not more than 20° C. provided that the refrigerant state in the outlet portion of the evaporator 7 is controlled by means of the superheating degree operating/controlling means 19. If the degree of dryness is larger than 0.1, the gas refrigerant will enter into the liquid pipe 6 whereby the natural circulation operation becomes unstable. Further, if the degree of supercooling is larger than 20° C., the excessive refrigerant will accumulate around the outlet portion of the condenser 2 so that a supercooling region in the condenser 2 is increased to reduce the heat transfer surface area effective for the condensation.

The degree of supercooling or the degree of dryness on the refrigerant state in the outlet portion of the condenser 2 may be controlled by changing the velocity of the outdoor fan 3 to change an air flow rate to the condenser 2 other than by changing the refrigerant quantity in the condenser 2 as described above. When the velocity of the outdoor fan 3 is increased to increase the air flow rate, the degree of supercooling is increased. On the other hand, when the velocity of the outdoor fan 3 is reduced to reduce the air flow rate, the degree of supercooling is reduced.

Embodiment 3

Figure 8:
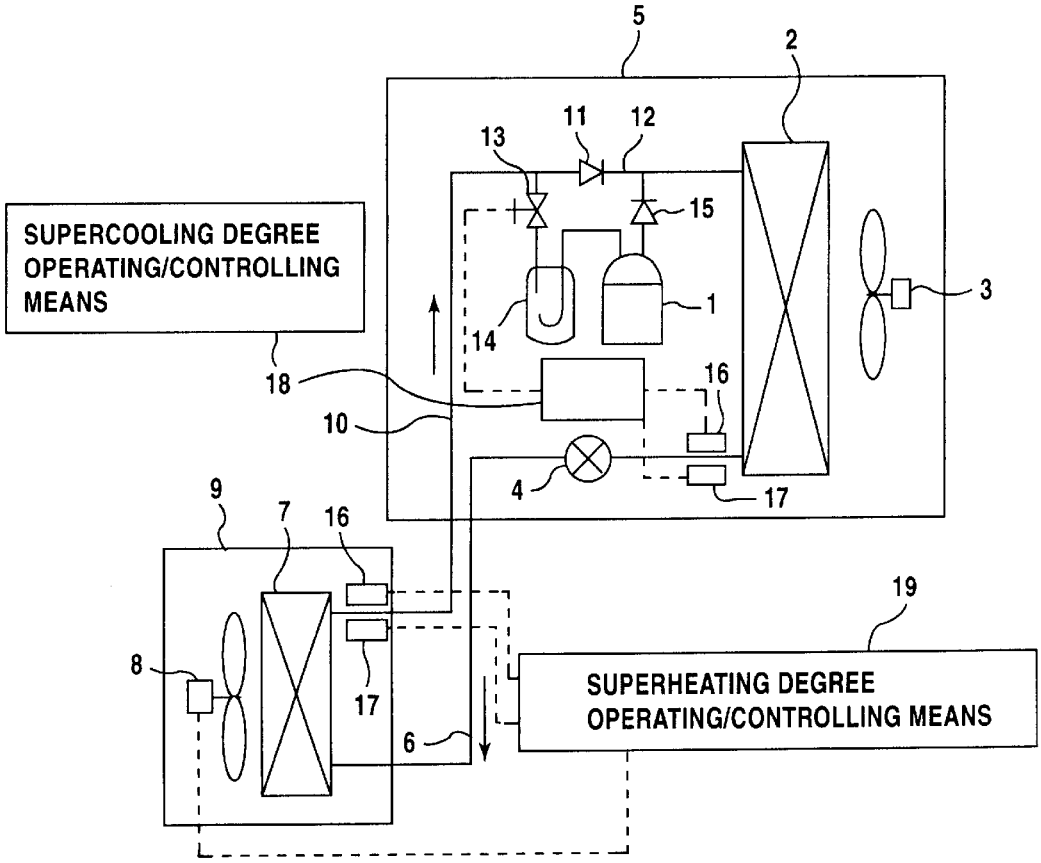
FIG. 8 is a circuit diagram showing the air conditioner according to a third embodiment of the present invention.

A method for controlling the air conditioner, as an air cooling apparatus, according to the third embodiment of the present invention will be described. FIG. 8 is a circuit diagram of the air conditioner according to the third embodiment wherein the same reference numerals as in FIG. 7 designate the same or corresponding parts.

The superheating degree operating/controlling means 19 can control to change the air flow rate to the evaporator 7 so that the refrigerant state in the outlet portion of the evaporator 7 has a predetermined degree of superheating. Further, the supercooling degree operating/controlling means 18 opens or closes the on-off valve 13 so that the refrigerant state in the outlet portion of the condenser 2 has a predetermined degree of supercooling so that the refrigerant quantity in the condenser 2 is changed by storing the refrigerant in the accumulator 14, in the same manner as the second embodiment.

Namely, the degree of superheating in the outlet portion of the evaporator 7 is calculated by means of the superheating degree operating/controlling means 19 based on detected values of the temperature sensor 16 and the pressure sensor 17 located in the outlet portion of the evaporator 7. The degree of superheating can be calculated by the superheating degree calculating formula (1) as follows.

$$\text{Degree of superheating (° C.)} = \text{Detected value of temperature} - \text{Saturated temperature based on detected value of pressure} \quad (1)$$

Then, the calculated value of superheating degree and a set value on the superheating degree (for example, about 5° C. in superheating degree) are compared, and the velocity of the indoor fan 8 is calculated based on a difference of the compared values. Then, the velocity of the indoor fan 8 is determined to be a velocity obtained by the calculation so as to change the air flow rate. For example, when the detected value of superheating degree is larger than the set value of superheating degree, the velocity is reduced to reduce the air flow rate whereby the degree of superheating is reduced. On the other hand, when the detected value of superheating degree is smaller than the set value of superheating degree, the velocity is increased to increase the air flow rate whereby the degree of superheating becomes high. By repeating such processes with predetermined intervals, e.g., time intervals of about 5 minutes, the air flow rate to the evaporator 7 is changed so that the degree of superheating in the outlet portion of the evaporator 7 can be controlled to reach the set value. Accordingly, the natural circulation operation in which the air conditioning ability is always at or around the maximum can be conducted.

Target values on the refrigerant state in the outlet portion of the evaporator 7 by means of the superheating degree operating/controlling means 19 are set so that they are within a value of a degree of dryness X of not less than 0.9 and a degree of superheating of not more than 10° C. The reason why a lower limit value of 0.9 in terms of a degree of dryness in the outlet portion of the evaporator 7 is that when the degree of dryness in the outlet portion of the evaporator 7 is less than 0.9, a pressure loss in the gas pipe 10 becomes large whereby the natural circulation operation can not efficiently be conducted. On the other hand, when the degree of superheating in the outlet portion of the evaporator 7 is larger than 10° C., a superheating region in the evaporator 7 is increased so that the heat transfer surface area effective for the evaporation is reduced.

Further, when the outdoor air temperature is high and the temperature difference between the outdoor air temperature and a set temperature for air conditioning in the room is small, the refrigerant quantity for providing the maximum air cooling ability is small as shown in FIG. 3. Accordingly, when the air flow rate is changed so that the degree of superheating in the outlet portion of the evaporator 7 becomes a set value (for example, about 5° C. in superheating degree), a distribution of refrigerant quantity in the refrigerant circuit is changed, and the excessive refrigerant is accumulated in the outlet portion of the condenser 2 whereby the degree of supercooling at the outlet of the condenser 2 is increased. Thus, an increase in the degree of supercooling in the outlet portion of the condenser 2 causes the reduction of the surface area of condensation in the condenser 2 become small whereby efficiency in the natural circulation operation becomes poor.

In the third embodiment of the present invention, the refrigerant state in the outlet portion of the condenser 2 is also controlled to have a predetermined set value in the same manner as the second embodiment. For example, the refrigerant quantity in the condenser is changed by using the accumulator 14 so that the degree of supercooling in the outlet portion of the condenser 2 becomes a set value in supercooling degree, e.g., 15° C. Further, the degree of supercooling can be controlled even by changing the velocity of the indoor fan 3. Description with respect to the control is omitted because it has been made in detail in the second embodiment.

As descried above, the air conditioner according to the third embodiment utilizes the phenomenon that the air conditioning ability becomes maximum when the degree of superheating in the outlet portion of the evaporator 7 is 0° C. in the natural circulation operation. By utilizing such phenomenon, control is so made that the degree of superheating at the outlet of the evaporator 7 becomes a set value in superheating degree (e.g., about 5° C. in superheating degree). Accordingly, the air conditioning ability in the natural circulation operation can be utilized at maximum without detecting the outdoor air temperature.

Further, the third embodiment of the present invention can prevent the reduction of the efficiency of the air conditioner caused by controlling the refrigerant state in the outlet portion of the evaporator 7 for this, the refrigerant state in the outlet portion of the condenser 2 is controlled so that it approaches a suitable set value (e.g., about 15° C. in supercooling degree). Thus, by controlling the refrigerant state in the outlet portion of the evaporator 7 and the condenser 2, a method for controlling the refrigerant so that the maximum air conditioning ability can be performed in the natural circulation operation, can be provided.

Embodiment 4

Figure 9:
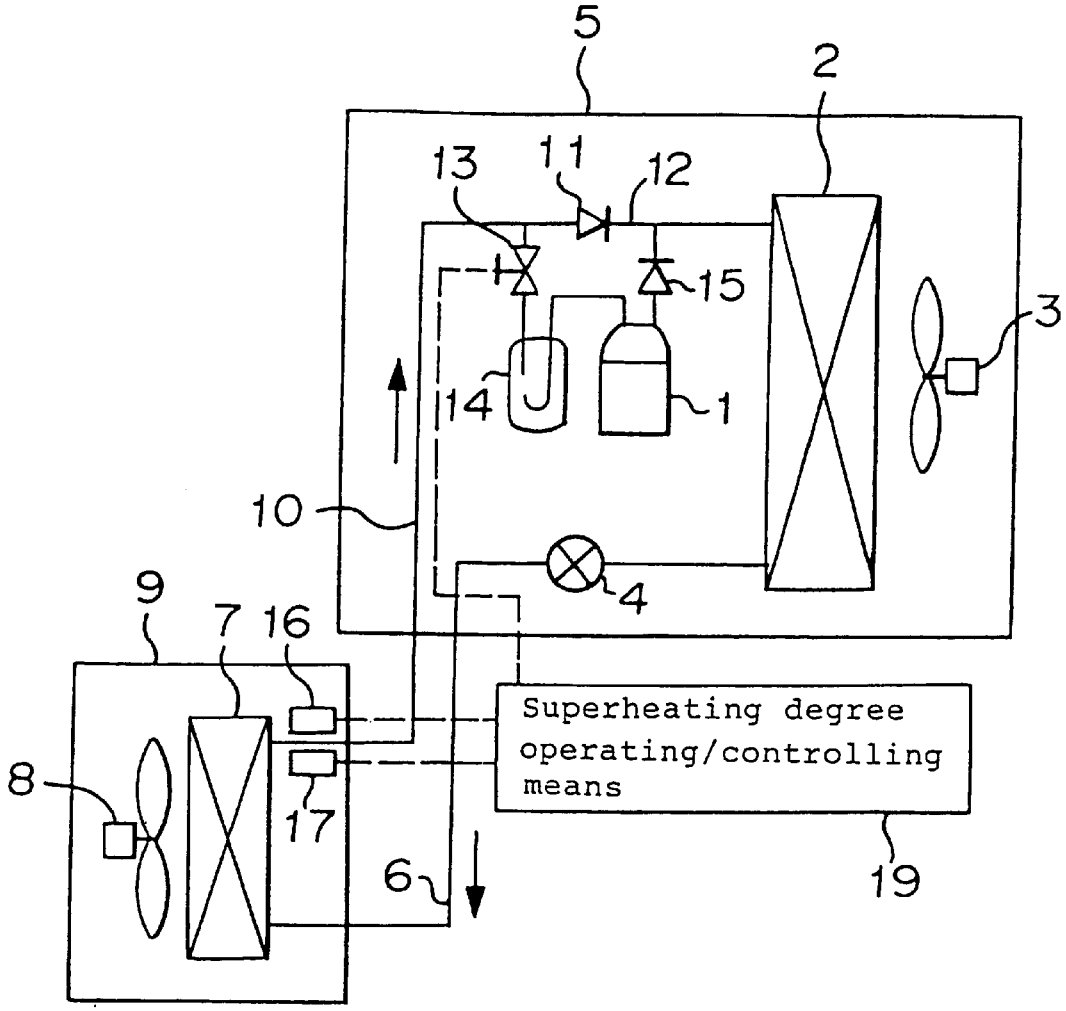
FIG. 9 is a circuit diagram showing the air conditioner according to a fourth embodiment of the present invention.

A method for controlling the refrigerant in the air conditioner such as an air cooling apparatus according to the fourth embodiment of the present invention will be described. FIG. 9 is a circuit diagram of the air conditioner of the fourth embodiment wherein the same reference numerals as in FIG. 7 designate the same or corresponding parts.

The superheating degree operating/controlling means 19 controls the refrigerant state in the outlet portion of the evaporator 7 to be a predetermined degree of superheating by changing the refrigerant quantity in the evaporator 7.

Namely, the degree of superheating in the outlet portion of the evaporator 7 is calculated by means of the superheating degree operating/controlling means 19 on the basis of values detected by the temperature sensor 16 and the pressure sensor 17 located in the outlet portion of the evaporator 7. The degree of superheating can be calculated by the following superheating degree calculation formula (1).

$$\text{Degree of superheating (}^\circ\text{ C.)} = \text{Detected value of temperature} - \text{Saturated temperature based on detected value of pressure} \quad (1)$$

Then, the detected value of superheating degree thus calculated and a set value of superheating degree (e.g., about 5° C. of superheating degree) are compared. When the detected value of superheating degree is lower than the set value of superheating degree, the on-off valve 13 is opened for a predetermined time, e.g., about 10 seconds based on a difference in the comparison. The fact that the detected value of superheating degree is lower than the set value of superheating degree means that the refrigerant quantity in the evaporator 7 is large and an excessive refrigerant liquid flows in the gas pipe 10. Accordingly, by opening and closing appropriately the on-off valve 13, a part of the refrigerant liquid flowing in the gas pipe 10 flows into the accumulator 14 to be stored. Accordingly, the degree of dryness in the outlet portion of the evaporator 7 is increased, and the refrigerant quantity is reduced, whereby the evaporator 7 keeps an appropriate amount of the refrigerant, and the degree of superheating in the outlet portion is changed to approach the set value of superheating degree.

By repeating such processes with predetermined time intervals, for example, intervals of about 5 minutes, the refrigerant quantity in the evaporator 7 is changed, and the degree of superheating in the outlet portion of the evaporator 7 is controlled to reach the set value. Accordingly, the natural circulation operation can be conducted so that the air conditional ability is always at or around the maximum.

In this case, the change of the refrigerant quantity by opening the on-off valve 13 means that the excessive refrigerant is removed from the refrigerant circuit in the natural circulation operation, and only the reduction of the refrigerant quantity in the evaporator 7 is possible. However, there is no problem in operation if a sufficient refrigerant quantity is put in the circuit in consideration that an excessive amount of refrigerant is produced in the natural circulation operation, and the excessive refrigerant is gradually stored in the accumulator by checking a change of the superheating degree, without varying a much amount refrigerant in the accumulator 14 at once.

The excessive refrigerant in the accumulator 14 caused by controlling the refrigerant quantity by means of the superheating degree operating/controlling means 19 is not again circulated in the refrigerant circuit during continued operation of natural circulation. However, it can be returned to the refrigerant circuit by the forced circulation operation with the operation of the compressor 1 and the refrigerant recovering operation.

The control of the degree of superheating in the fourth embodiment causes the reduction of the refrigerant quantity in the evaporator 7. In fact, however, it reduces the refrigerant quantity in the entire refrigerant circuit in the natural circulation operation. Accordingly, such phenomenon that as in the second embodiment and the third embodiment, a distribution of refrigerant quantity is changed by changing the refrigerant flow rate or the air flow rate and the excessive refrigerant stays in the condenser 2 does not appear. Accordingly, unlike the second embodiment and the third embodiment wherein the refrigerant state in the outlet portion of the condenser 2 is controlled, the natural circulation operation in which the air conditioning ability is performed at the maximum can be conducted. The second embodiment to the fourth embodiment concern such method that the refrigerant flow rate, the air flow rate to the evaporator 7 or the refrigerant quantity in the evaporator 7 is changed so that the refrigerant state in the outlet portion of the evaporator 7 has a predetermined degree of superheating. Namely, it is sufficient to change at least one of the refrigerant flow rate, the air flow rate to the evaporator 7 and the refrigerant quantity in the evaporator 7. Depending on circumstances, however, all these three conditions: the refrigerant flow rate, the air flow rate to the evaporator 7 and the refrigerant quantity in the evaporator 7 may be changed so that the refrigerant state in the outlet portion of the evaporator 7 becomes to have a predetermined degree of superheating, or two conditions among the above-mentioned three conditions may be changed so as to render the refrigerant state to have a predetermined degree of superheating.

Embodiment 5

Description will be made as to a method for controlling refrigerant in an air conditioner according to the fifth embodiment of the present invention. In the fifth embodiment, a controlled target range for the degree of superheating is used for the refrigerant state in the outlet portion of the evaporator, and a controlled target range for the degree of supercooling is used for the refrigerant state in the outlet portion of the condenser. The circuit diagram of the air conditioner according to the fifth embodiment is the same as that of FIG. 7.

Figure 10:
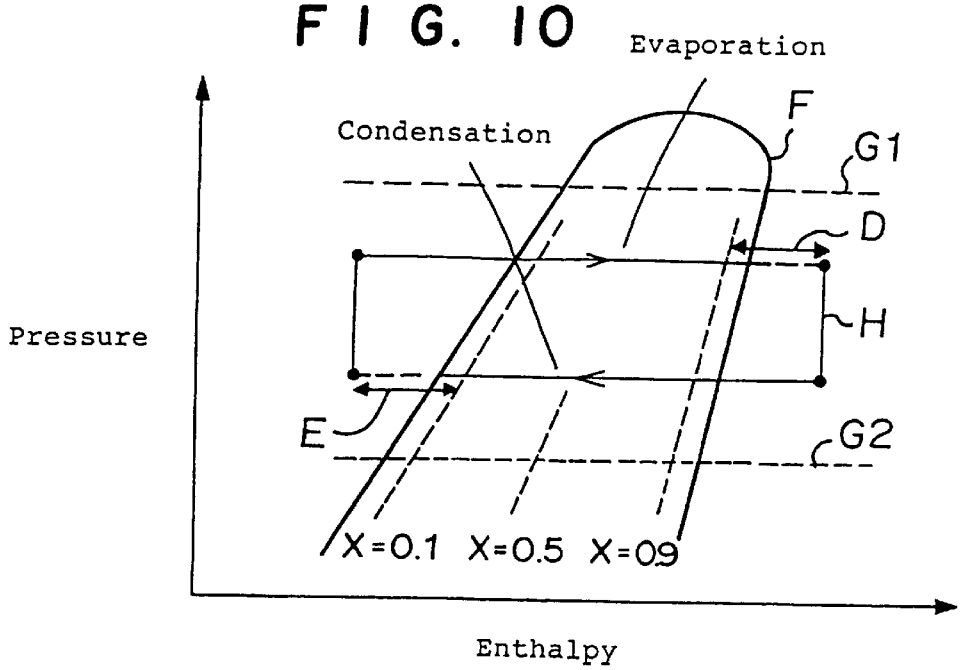
FIG. 10 is a pressure-enthalpy diagram related to a fifth embodiment of the present invention.

FIG. 10 is a pressure-enthalpy diagram wherein F represents a saturated liquid line (a saturated gas line) G1 represents a saturated pressure corresponding to an indoor air temperature and G2 represents a saturated pressure corresponding to an outdoor air temperature. H represents a cycle showing a change of state on the pressure-enthalpy line wherein a range D represents a controlled target range on a degree of dryness (inside of the saturated gas line F) and a degree of superheating (outside of the saturated gas line F) in the outlet portion of the evaporator 7, and a range E is a controlled target range on a degree of dryness (inside of the saturated liquid line F) and a degree of supercooling (outside of the saturated liquid line F) in the outlet portion of the condenser 2.

In the controlled target range D, when the refrigerant state in the outlet portion of the evaporator 7 shows a degree of superheating=0° C., the air conditioning ability is the maximum and it is on the saturated gas line. The degree of superheating increases as the state is shifted to a right side on the saturated gas line in FIG. 10. On the other hand, the degree of superheating is remained 0° C. in a left side portion on the saturated gas line. For that portion, a degree of dryness X is used instead of the degree of superheating, as an index representing the refrigerant state. The degree of dryness decreases as the state is shifted on a left side on the saturated gas line. The controlled target range D of the refrigerant state in the outlet portion of the evaporator 7 is preferably in ranges of not less than 0.9 in terms of a degree of dryness X and not more than 10° C. in terms of a degree of superheating.

Here, the degree of dryness is the ratio of a refrigerant gas flow rate to the entire refrigerant flow rate, and it can be calculated by the following dryness calculation formula (3).

$$\text{Degree of dryness}=\text{Gas flow rate in mass}/(\text{Gas flow rate in mass}+\text{Liquid flow rate}) \quad (3)$$

A set value for the refrigerant state in the outlet portion of the evaporator 7 is determined within the range D, and then, the refrigerant flow rate, the air flow rate to the evaporator 7 or the refrigerant quantity in the evaporator 7 is controlled so that refrigerant state reaches the set value. As described before, the degree of superheating can be calculated from the above mentioned formula (1) based on values detected by the temperature sensor 16 and the pressure sensor 17 by using the before-mentioned formula 1. Further, the degree of dryness can be obtained by, for example, providing a dryness degree detecting sensor in the outlet portion of the evaporator 7.

The reason why a lower limit of 0.9 in terms of degree of dryness in the outlet portion of the evaporator 7 is that when the degree of dryness in the outlet portion of the evaporator 7 is less than 0.9, a pressure loss in the gas pipe 10 becomes large, and the natural circulation operation can not efficiently be performed. On the other hand, when the degree of superheating in the outlet portion of the evaporator 7 is larger than 10° C., a superheating region in the evaporator 7 is increased so that the heat transfer surface area effective for the evaporation is reduced. Accordingly, the set value for the refrigerant state in the outlet portion of the evaporator 7 should be values in the range of not less than 0.9 in terms of a degree of dryness and not more than 10° C. in terms of a degree of superheating so that the heat transfer surface area in the evaporator can effectively be utilized while an increase in the pressure loss in the gas pipe is controlled.

For example, when the refrigerant state in the outlet portion of the evaporator 7 is controlled by changing the refrigerant flow rate by means of the electronic expansion valve 4 within the target range D and if the refrigerant state is desired to change in a right side direction i.e., the degree of superheating is made larger or the degree of dryness is made larger, the degree of opening of the electronic expansion valve 4 is throttled to reduce the refrigerant flow rate. On the contrary, when the refrigerant state is to be changed in a left side direction, namely, the degree of superheating is made smaller or the degree of dryness is made smaller, the degree of opening of the electronic expansion valve 4 is increased so as to increase the refrigerant flow rate.

Further, for example, when the refrigerant state in the outlet portion of the evaporator 7 is controlled by changing the velocity of the indoor fan 8, hence, the air flow rate to the evaporator 7 is changed and if the refrigerant state is to be changed in a right side direction, i.e., the degree of superheating is made larger or the degree of dryness is made larger, the velocity of the indoor fan 8 is increased to increase the air flow rate. On the contrary, when refrigerant state is to be changed in a left side direction, i.e., the degree of superheating is made smaller or the degree of dryness is made smaller, the velocity of the indoor fan 8 is decreased to decrease the air flow rate.

Further, for example, when the refrigerant state in the outlet portion of the evaporator 7 by opening the electromagnetic valve 13 to change the refrigerant quantity in the evaporator 7, i.e., the refrigerant quantity in the evaporator 7 is reduced, the refrigerant state is changed in a right side direction.

Further, the controlled target range E for the refrigerant state at the outlet of the condenser 2 is preferably in the range of not more than 0.1 in terms of a degree of dryness X and not more than 20° C. in terms of a degree of supercooling. As described before, the degree of supercooling can be calculated from the before-mentioned supercooling degree calculation formula (2) based on values detected by the temperature sensor 16 and the pressure sensor 17. Further, the degree of dryness can be obtained by providing, for instance, a dryness sensor in the outlet portion of the condenser 2.

The reason why an upper limit of 0.1 in terms of a degree of dryness in the outlet portion of the condenser 2 is that if the degree of dryness in the outlet portion of the condenser 2 is larger than 0.1, the gas refrigerant flows into the liquid pipe 6 and the natural circulation operation becomes unstable. On the other hand, when the degree of supercooling in the outlet portion of the condenser 2 is larger than 20° C., a supercooling region in the condenser 2 is increased and the heat transfer surface area effective for the condensation is reduced. Accordingly, the set value for the refrigerant state in the outlet portion of the condenser should be within the range of not more than 0.1 in terms of a degree of dryness and not more than 20° C. in terms of a degree of supercooling so that the heat transfer surface area in the condenser can effectively utilized and the natural circulation operation can stablly be conducted.

For example, when the refrigerant state in the outlet portion of the condenser 2 is controlled by changing the refrigerant flow rate by means of the electronic expansion valve 4 in the controlled target range E, and if the refrigerant state is to be changed in a right side direction, i.e., the degree of supercooling is made smaller or the degree of dryness is made larger, the degree of opening of the electronic expansion valve 4 is increased so as to increase the refrigerant flow rate. On the contrary, when the refrigerant state is to be changed in a left side direction, i.e., the degree of supercooling is made larger or the degree of dryness is made smaller, the degree of opening of the electronic expansion valve 4 is made small so as to reduce the refrigerant flow rate.

Further, for example, when the refrigerant state in the outlet portion of the condenser 7 is controlled by changing the velocity of the outdoor fan 3 to change the air flow rate to the condenser 2, and if the refrigerant state is to be changed in a right side direction, i.e., the degree of supercooling is made smaller or the degree of dryness is made larger, the velocity of the outdoor fan 3 is reduced to reduce the air flow rate. On the contrary, when the refrigerant state is to be changed in a left side direction, i.e., the degree of superheating is made larger or the degree of dryness made smaller, the velocity of the outdoor fan 3 is increased to increase the air flow rate.

Further, for example, when the refrigerant state in the outlet portion of the condenser 2 is controlled by opening the electromagnetic valve 13 to change the refrigerant quantity in the condenser 2 and if the refrigerant quantity in the condenser 2 is reduced by opening the electromagnetic valve 13, the refrigerant state is changed in a right side direction.

Thus, by controlling the refrigerant state in the outlet portion of the evaporator 7 and the refrigerant state in the outlet portion of the condenser 2, the maximum air conditioning ability can be performed in the natural circulation operation, and effect for reducing consumption power as an advantage in the natural circulation operation can further be improved.

The above-mentioned operation to obtain the maximum air conditioning ability in the natural circulation operation by controlling the refrigerant state in the outlet portion of the evaporator 7 and/or the outlet portion of the condenser 2 is preferably conducted in a case that the temperature difference between the outdoor air temperature and a set temperature for air conditioning is 25° C. or lower. The reason is described with reference to FIG. 4. Assuming that the temperature difference between the outdoor air temperature and a set temperature for air conditioning is 25° C. or higher and a set temperature for the room is 38° C. When the outdoor air temperature becomes lower than 13° C., the air conditioning load is reduced so that the inside of the shelter as a space to be air-conditioned is excessively cooled due to an excessive air cooling ability. Accordingly, use of the above-mentioned temperature difference prevents reduction in reliability for communication devices disposed in the shelter.

Embodiment 6

Description will be made as to the air conditioner, e.g., an air cooling apparatus according to the sixth embodiment of the present invention.

Figure 11:
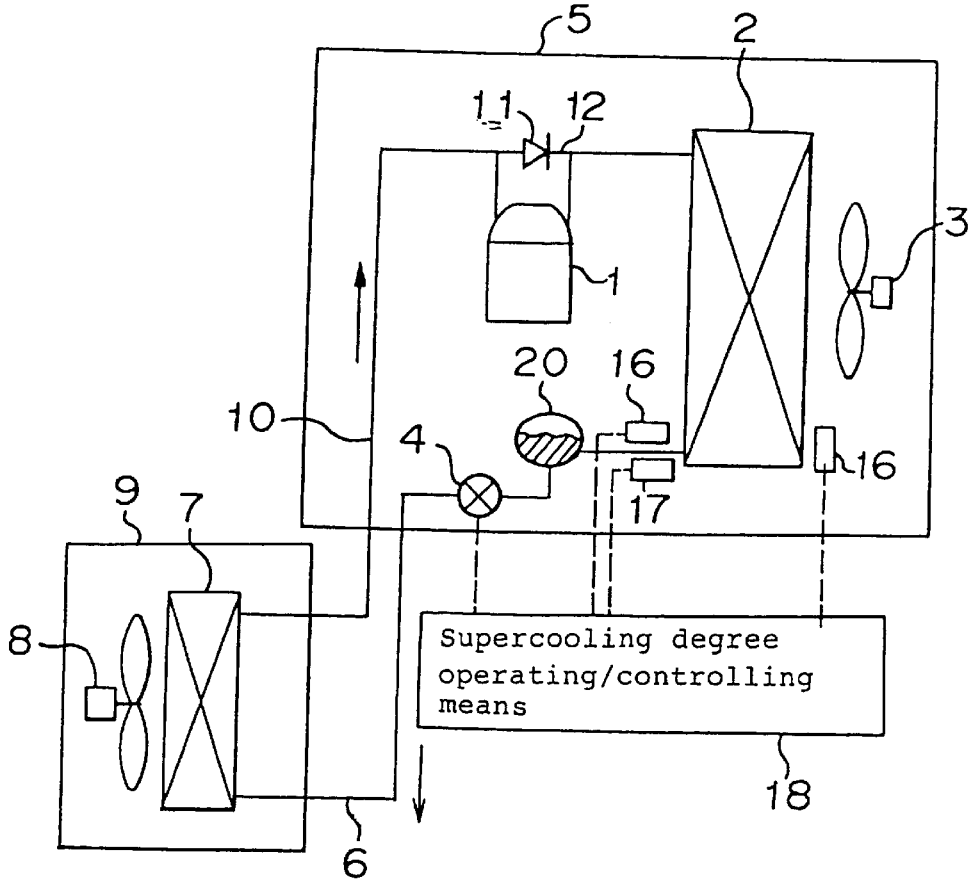
FIG. 11 is a circuit diagram showing the air conditioner according to a sixth embodiment of the present invention.

FIG. 11 is a circuit diagram of the air conditioner of the sixth embodiment. In FIG. 11, reference numeral 20 designates a refrigerant storing means as a reservoir located in an outlet portion of the condenser 2 to store the refrigerant liquid from the condenser 2. The outdoor unit 5 is provided with an outdoor air temperature sensor 16 for detecting an outdoor air temperature. In FIG. 11, the same reference numerals as FIG. 1 designate the same or corresponding parts.

The air conditioner of the sixth embodiment comprises the outdoor unit 5, the indoor unit 9 and the liquid pipe 6 and the gas pipe 10 which connect these units.

The outdoor unit 5 comprises the compressor 1 for compressing refrigerant gas, the condenser 2 for liquefying the refrigerant gas, the outdoor fan 3, as a blower, to supply forcibly outer air to an outer surface of the condenser 2, the electronic expansion valve 4 as a refrigerant flow controlling means, which conducts pressure reduction of the refrigerant of high temperature and high pressure discharged from the condenser 2 to form a wet vapor in two-phase state and the reservoir 20 for storing the refrigerant liquid.

The indoor unit 9 comprises the evaporator 7 for vaporizing the wet vapor introduced through the liquid pipe into refrigerant gas depending on an air conditioning load in a space to be air-conditioned, and the indoor fan 8 as a blower to supply room air forcibly to the outer surface of the evaporator 7.

The reservoir 20 as a refrigerant storing means is located at a level corresponding to a lower portion of the condenser 2. A pipe connecting the reservoir 20 to the condenser 2 to pass the refrigerant from the condenser 2 and a pipe connecting the reservoir 20 to the electronic expansion valve 4 are respectively connected to lower portions of the reservoir 20. The reservoir 20 has a capacity sufficient to receive the refrigerant liquid corresponding to a proper quantity of refrigerant which is resulted from the difference in function between the forced circulation operation and the natural circulation operation. In this case, the reservoir 20 is provided in place of the accumulator 14 used in the second embodiment.

In the air conditioner of the sixth embodiment, when the forced circulation operation is conducted, the degree of opening of the electronic expansion valve 4 is adjusted to an appropriate degree of opening to reduce the pressure of the refrigerant liquid discharged from the condenser 2 to be a wet vapor in a two-phase state. And also, the compressor 1 is operated. In this case, the check valve 11 is closed due to the pressure difference between a discharge pressure and an intake pressure of the compressor 1, thus a cycle of the forced circulation operation is formed.

Further, in starting the natural circulation operation, when the electronic expansion valve 4 is fully opened for example, the check valve 11 is opened according to the refrigerant flow and a cycle of natural circulation is formed. In this case, the refrigerant tends to flow in a flow path to the compressor 1. However, the flow resistance of the inside of the compressor 1 is very high in comparison with the flow resistance of the bypass pipe 12. Accordingly, the refrigerant flow rate passing through the compressor 1 is small as being neglected with respect to the refrigerant flow rate passing through the bypass pipe 12.

In the above-mentioned second embodiment to fourth embodiment, description has been made on the method for controlling the refrigerant so that the air cooling ability in the natural circulation operation can be utilized to the maximum wherein a degree of superheating as a refrigerant state in the outlet portion of the evaporator 7 is detected by means of the temperature sensor 16 and the pressure sensor 17 provided in the outlet portion of the evaporator 7, and the detected degree of superheating is determined to be a set value to conduct the control. In the sixth embodiment, however, a degree of supercooling of the refrigerant at the outlet of the condenser 2 is detected by means of the temperature sensor 16 and the pressure sensor 17 provided in the outlet portion of the condenser 2, and the degree of supercooling in the outlet portion of the condenser 2 is determined to be a set value for conducting the control in response to the detected degree of supercooling and an outdoor air temperature. The sixth embodiment uses a method for controlling the degree of superheating in the outlet portion of the evaporator 7 to be a set value by controlling the degree of supercooling in the outlet portion of the condenser 2.

As shown in FIG. 2, the degree of superheating in the outlet portion of the evaporator is simply reduced and the degree of supercooling in the outlet portion of the condenser is simply increased as the refrigerant amount is increased. Namely, a value of superheating degree in the outlet portion of the evaporator and a value of supercooling degree in the outlet portion of the condenser is in a relation of 1:1. For example, the graph at a lower side of FIG. 2 shows a change of the superheating degree (black circles) in the outlet portion of the evaporator and a change of the supercooling degree (white circles) in the outlet portion of the condenser with respect to a refrigerant quantity when the temperature difference between an outdoor air temperature and a set temperature for air conditioning is 33° C. From this relation, control may be conducted such that the degree of superheating in the outlet portion of the evaporator is determined to be a desired set value, e.g., 0° C., and instead, the degree of supercooling in the outlet portion of the condenser is determined to a set value such as 15° C. so as to correspond to the value of superheating. The relation of the degree of superheating to the degree of supercooling will change depending on a change of the temperature difference between an outdoor air temperature and a set temperature for air conditioning. Accordingly, in the sixth embodiment, control is so made that a degree of supercooling at the outlet of the condenser which corresponds to a set value (e.g., 0° C.) in terms of a degree of superheating of the refrigerant state at the outlet of the evaporator; an outdoor air temperature is detected; the temperature difference between the detected outdoor air temperature and the set temperature for air conditioning is obtained, and the degree of supercooling in the outlet portion of the condenser is determined to be a set value under the condition of the temperature difference. Specifically, the degree of supercooling in the outlet portion of the condenser 2 is controlled by changing the refrigerant flow rate by means of the electronic expansion valve 4, by increasing or decreasing the velocity of the outdoor fan 3 to change the air flow rate to the condenser 2, or by increasing or decreasing the velocity of the indoor fan 8 to change the air flow rate to the evaporator 7.

The method for controlling refrigerant in the sixth embodiment will be described in more detail.

In the sixth embodiment, an accumulator is not disposed near an sucking portion of the compressor 1. Accordingly, the reservoir 20 functions to adjust a difference of refrigerant quantity resulted from the difference of function between the forced circulation operation and the natural circulation operation. Namely, since a refrigerant quantity required in the forced circulation operation is smaller than that in the natural circulation operation, an excessive refrigerant in a state of supercooled liquid from the outlet portion of the condenser 2 is stored in the reservoir 20.

In the natural circulation operation, the degree of supercooling in the outlet portion of the condenser 2 is calculated by the supercooling degree operating/controlling means 18 based on values detected by the temperature sensor 16 and the pressure sensor 17 provided in the outlet portion of the condenser 2. The calculation can be conducted according to the following supercooling degree circulation formula (2).

$$\text{Degree of supercooling (° C.)} \quad \text{Saturated temperature based on detected value of pressure} - \text{Detected value of temperature} \qquad (2)$$

Then, the degree of supercooling obtained by the calculation and the set value of degree of supercooling based on the temperature difference between the outdoor air temperature detected by the outdoor temperature sensor 16 and the set temperature for air conditioning are compared. Then, the degree of opening of the electronic expansion valve 4 is calculated based on a value of difference obtained by comparison Finally, the degree of opening of the electronic expansion valve 4 is set to a value obtained by the calculation. By repeating such operations with predetermined time intervals, e.g., 5 minutes, the degree of supercooling at the outlet of the condenser 2 can be controlled to a set value in response to the temperature difference between the outdoor air temperature and the set temperature for air conditioning. Such control is the same as the control wherein the degree of superheating showing the refrigerant state in the outlet portion of the evaporator 7 is so adjusted that the air conditioning ability is at or around the maximum.

For example, when the refrigerant state in the outlet portion of the condenser 2 is controlled by changing the refrigerant flow rate by the electronic expansion valve 4 and if the degree of supercooling is made smaller or the degree of dryness is made larger, the degree of opening of the electronic expansion valve 4 is made large so as to increase the refrigerant flow rate. On the other hand, when the degree of supercooling is to be made large or the degree of dryness is to be made small, the degree of opening of the electronic expansion valve 4 is made small so as to reduce the refrigerant flow rate.

Further, the refrigerant state in the outlet portion of the condenser 2 can be controlled by changing the velocity of the outdoor fan 3 to change the air flow rate to the condenser 2. For example, when the degree of supercooling is made small or the degree of dryness is made large, the velocity of the outdoor fan 3 is reduced so as to reduce the air flow rate. On the other hand, when the degree of supercooling is made large or the degree of dryness is made small, the velocity of the outdoor fan 3 is increased so as to increase the air flow rate.

In case that an outdoor air temperature is high and a temperature difference between the outdoor air and the room is small, a refrigerant quantity providing the maximum air cooling ability becomes small as shown in FIG. 3. Accordingly, an excessive refrigerant quantity is accumulated in the outlet portion of the condenser 2 by properly changing the refrigerant flow rate or the air flow rate. In the sixth embodiment, since the excessive refrigerant is stored in the reservoir 20 provided in the outlet portion of the condenser 2, it is possible to maintain the refrigerant in the vicinity of the condenser 2 to be an appropriate state regardless of a change of the outdoor air temperature.

Further, the air conditioner of the sixth embodiment may be provided with the accumulator 14 as shown in FIG. 7 without providing the reservoir 20, and the supercooling degree operating/controlling means 18 is so controlled as to open or close the on-off valve 13 so that the degree of supercooling in the outlet portion of the condenser is calculated, and the calculated value of supercooling is determined to be a set value. In this case, the degree of supercooling or the degree of dryness in the outlet portion of the condenser is controlled by changing an effective quantity of refrigerant in the refrigerant circuit in the natural circulation operation. In this case, the degree of opening of the electronic expansion valve 4 should be fixed to be constant such as being fully opened.

As described above, since the air conditioner of the sixth embodiment wherein an outdoor air temperature is detected, and the degree of supercooling or the degree of dryness in the outlet portion of the condenser 2 is controlled to be an appropriate value, the evaporator 7 and the condenser 2 are always maintained in a suitable state, and the air cooling ability in the natural circulation operation is performed to the maximum.

Further, in the circuit structure shown in FIG. 11, since the adjustment of the refrigerant quantity is conducted by the reservoir 20 provided near a lower portion of the outlet portion of the condenser 2 without using an external input such as an electric heater, a large effect of reducing consumption power can be obtained.

Further, the reservoir 20 is provided between the outlet of the condenser 2 and the electronic expansion valve 4. Accordingly, when the operation is changed from the forced circulation operation to the natural circulation operation, the above-mentioned refrigerant recovering operation is unnecessary. Namely, the refrigerant liquid stored in the reservoir 20 can instantaneously be circulated by increasing, e.g., fully opening, the degree of opening of the electronic expansion valve 4 for the natural circulation operation.

An excessive refrigerant produced in the natural circulation operation or the forced circulation operation is automatically stored in the reservoir 20 as a refrigerant storing means. Therefore, it is unnecessary to examine an excessive refrigerant or to conduct a complicated control such as opening or closing the on-off valve in response to the excessive refrigerant. Further, the adjustment of the refrigerant quantity can be automatically conducted in such a manner that the refrigerant quantity in the condenser or the evaporator is reduced by storing the excessive refrigerant or the refrigerant quantity in the condenser or the evaporator is increased by discharging the stored refrigerant.

Further, since the refrigerant state in the outlet portion of the evaporator 7 can be controlled by controlling the refrigerant state only in the outlet portion of the condenser, the air conditioner having a simple structure wherein the air conditioning ability in the natural circulation operation can be performed to the maximum is obtainable.

Concerning the controlled target value for the refrigerant state in the outlet portion of the condenser 2, the same explanation as in the fifth embodiment applies. Namely, the degree of supercooling or the degree of dryness in the outlet portion of the condenser 2 is determined to be in ranges of not less than 0.9 in terms of a degree of dryness X and not more than 10° C. in terms of a degree of superheating. The reason why an upper limit value of 0.9 in terms of a degree of dryness in the outlet portion of the evaporator 7 is determined is that if the degree of dryness is smaller than 0.9, a pressure loss in the gas pipe 10 is increased so that the natural circulation operation can not effectively be conducted. On the other hand, when the degree of superheating in the outlet portion of the evaporator 7 is larger than 10° C., a superheating region in the evaporator 7 is increased whereby the heat transfer surface area effective for the evaporation is reduced.

In determining the degree of supercooling in the outlet portion of the condenser 2 based on a set value of superheating in the outlet portion of the evaporator 7, the set value of supercooling may be modified slightly so that the degree of dryness in the outlet portion of the condenser 2 is not more than 0.1 and the degree of supercooling is not more than 20° C. The reason is as follows. When the degree of dryness in the outlet portion of the condenser 2 is larger than 0.1, the gas refrigerant enters in the liquid pipe 6 to make the natural circulation operation unstable, and when the degree of supercooling is larger than 20° C., the supercooling region in the condenser 2 is increased whereby the heat transfer surface area effective for condensation is reduced.

Embodiment 7

In the following, description will be made as to the air conditioner as an air cooling apparatus according to the seventh embodiment of the present invention.

Figure 12:
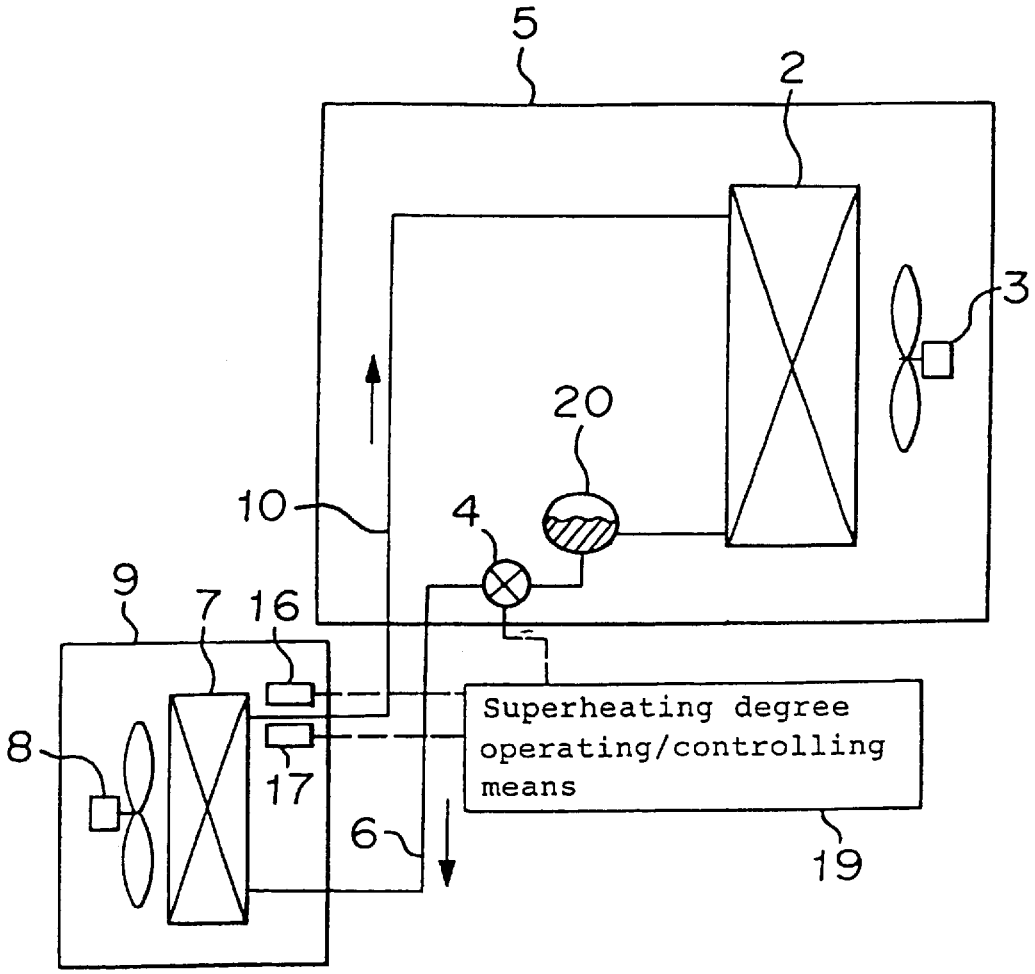
FIG. 12 is a circuit diagram showing the air conditioner according to a seventh embodiment of the present invention.

FIG. 12 is a circuit diagram of the air conditioner of the seventh embodiment. The air conditioner of the seventh embodiment is operated so that air cooling is conducted only by the natural circulation operation under the condition that the outdoor air temperature is not higher than a set value in a space to be air-conditioned. Namely, the air conditioner is usually used for air cooling by a cold heat from the outside.

The air cooling apparatus according to the seventh embodiment will be described with reference to FIG. 12 wherein the same reference numerals designate the same or corresponding parts.

The condenser 2 is placed at, for example, a position of about 1.4 m higher than the evaporator 7 in the same manner as the first embodiment. Further, the circuit structure is constituted by the outdoor unit 5, the indoor unit 9 and liquid pipe 6 and the gas pipe 10 which connect these units in the same manner as the first embodiment.

The outdoor unit 5 comprises the condenser 2 for liquefying the refrigerant gas, the outdoor fan 3, as a blower, to supply outer air forcibly to an outer surface of the condenser 2, the electronic expansion valve 4, as a refrigerant flow controlling means, which is disposed in a pipe at a position between an outlet portion of the condenser 2 and an inlet portion of the evaporator 7 to control the refrigerant flow rate, and the reservoir 20 as a refrigerant storing means for storing the refrigerant liquid in the outlet portion of the condenser.

The indoor unit 9 comprises the evaporator 7 for vaporizing the refrigerant liquid introduced from the liquid pipe 6 into the refrigerant gas depending on an air conditioning load in a space to be air-conditioned and the indoor fan 8 as a blower to supply indoor air forcibly to an outer surface of the evaporator 7.

The reservoir 20 is disposed at a level corresponding to a lower portion of the condenser 2. A pipe through which the refrigerant from the condenser 2 flows and a pipe for passing the refrigerant into the electronic expansion valve 4 are connected to lower portions of the reservoir 20. The reservoir 20 is to supply an effective amount of refrigerant in the refrigerant circuit in the natural circulation operation depending on a temperature difference between an outdoor air temperature and a set temperature for air conditioning. It is sufficient for the reservoir in the seventh embodiment to have a smaller capacity than the reservoir used in the air conditioner usable for both the forced circulation operation and the natural circulation operation in the sixth embodiment.

In the following, a method for controlling refrigerant in the natural circulation operation will be described.

First, as shown in FIG. 4, an amount of refrigerant in which the outdoor air temperature capable of air conditioning shows the maximum with respect to an air conditioning load to the air conditioner, is charged in the refrigerant circuit of the seventh embodiment. Then, the natural circulation operation is started. When the outdoor air temperature is lower than the maximum outdoor air temperature capable of air conditioning, the air conditioning ability sufficiently covers the air conditioning load. If the air conditioning ability is too large to cover the air conditioning load so that the room to be air-conditioned is excessively cooled, the operation of, for example, the indoor fan 8 and/or the outdoor fan 3 should be stopped so as to control the air flow rate to the evaporator 7 and/or the condenser 2 whereby the heat exchanging rate be reduced.

On the other hand, when the outdoor air temperature exceeds the maximum outdoor air temperature capable of air conditioning, the operation is controlled so as to provide the maximum air conditioning ability obtainable in the structure of this embodiment. As shown in FIG. 2, there is the phenomenon that the degree of superheating in the outlet portion of the evaporator 7 is 0° C. at which the air conditioning ability becomes the maximum even though there is a change of the temperature difference between the outdoor air temperature and a set temperature for air conditioning. This phenomenon is utilized. For example, the set temperature of superheating is determined to have a positive value close to 0° C. such as 5° C., and the degree of superheating at the outlet of the evaporator 7 is controlled to reach the set value of superheating whereby the operation in a state that the air cooling ability is at or around the maximum can be obtained.

In the air conditioner according to the seventh embodiment, the control for the degree of superheating in the outlet portion of the evaporator 7 in the natural circulation operation is as follows. Namely, the degree of superheating in the outlet portion of the evaporator 7 is calculated by means of the superheating degree operating/controlling means 19 based on values detected by the temperature sensor 16 and the pressure sensor 17 located in the outlet portion of the evaporator 7. The degree of superheating can be calculated by the following superheating degree calculation formula (1).

$$\text{Degree of superheating (° C.)} \quad \text{Detected value of temperature} - \text{Saturated temperature based on detected value of pressure} \qquad (1)$$

Then, the detected value of superheating obtained by the calculation and a set value of superheating (e.g., about 5° C.) are compared. The degree of opening of the electronic expansion valve 4 is calculated based on a difference obtained by the comparison. Then, the degree of opening of the electronic expansion valve 4 is adjusted to have the degree of opening obtained by the calculation. For example, when the detected value of superheating is larger than the set value of superheating, the degree of opening of the valve is made large to increase the refrigerant flow rate to thereby reduce the degree of superheating. On the contrary, when the detected value of superheating is smaller than the set value of superheating, the degree of opening is made small to reduce the refrigerant flow rate with the result of increasing the degree of superheating. By repeating the above-mentioned processes with predetermined time intervals, e.g., time intervals of about 5 minutes, the degree of superheating in the outlet portion of the evaporator is controlled to be the set value. Thus, the natural circulation operation in which the air conditioning ability is usually maintained at or around the maximum can be conducted.

Since the air conditioner according to the seventh embodiment does not use an electric heater or the like, the effect for reducing consumption power as a characteristic feature of the natural circulation operation can be obtained.

As shown in FIG. 3, when the outdoor air temperature is high and the temperature difference between the outdoor and the indoor is small, a refrigerant quantity in which the air cooling ability is the maximum is small. Accordingly, an excessive amount refrigerant is stored in the reservoir 20 by changing the degree of opening of the electronic expansion valve 4 so that the degree of superheating in the outlet portion of the evaporator 7 reaches a set value of superheating (e.g., about 5° C. in terms of a degree of superheating). In a structure without providing the reservoir 20, the excessive refrigerant liquid is accumulated in the outlet portion of the condenser 2 whereby the degree of supercooling in the outlet portion of the condenser 2 increases. Thus, when the degree of supercooling in the outlet portion of the condenser 2 is increased, the surface area for condensation in the condenser 2 becomes small to thereby deteriorate efficiency in the natural circulation operation. In the seventh embodiment, however, the excessive refrigerant is naturally stored in the reservoir 20 and a reduction of efficiency can be prevented.

Further, when a higher air conditioning ability is obtainable with an increased refrigerant quantity in the refrigerant circuit as a result of increasing the temperature difference between the outdoor temperature and a set temperature for air conditioning, an excessive amount of refrigerant stored in the reservoir 20 is gradually reduced in the course of controlling properly the refrigerant state in the outlet portion of the evaporator 7. The reduced amount of refrigerant is circulated in the refrigerant circuit whereby the adjustment of the refrigerant quantity is made naturally.

Further, the supercooling degree operating/controlling means 18 for calculating and controlling the degree of supercooling in the outlet portion of the condenser 2 as in the second embodiment may be provided in place of the superheating degree operating/controlling means 19. In this case, the supercooling degree operating/controlling means 18 is so adapted to change the degree of opening of the electronic expansion valve 4 based on the degree of supercooling calculated based on the temperature and the pressure in the outlet portion of the condenser 2 and the temperature difference between the outdoor air temperature and the set temperature for air conditioning.

Further, the refrigerant state in the outlet portion of the evaporator 7 may be controlled by changing the velocity of the indoor fan 8 or the outdoor fan 3, or changing the air flow rate to the evaporator 7 or the condenser 2 in the same manner as in the third embodiment.

Embodiment 8

In the following, description will be made as to the air conditioner according to the eighth embodiment of the present invention, by taking an air conditioning apparatus as example.

Figure 13:
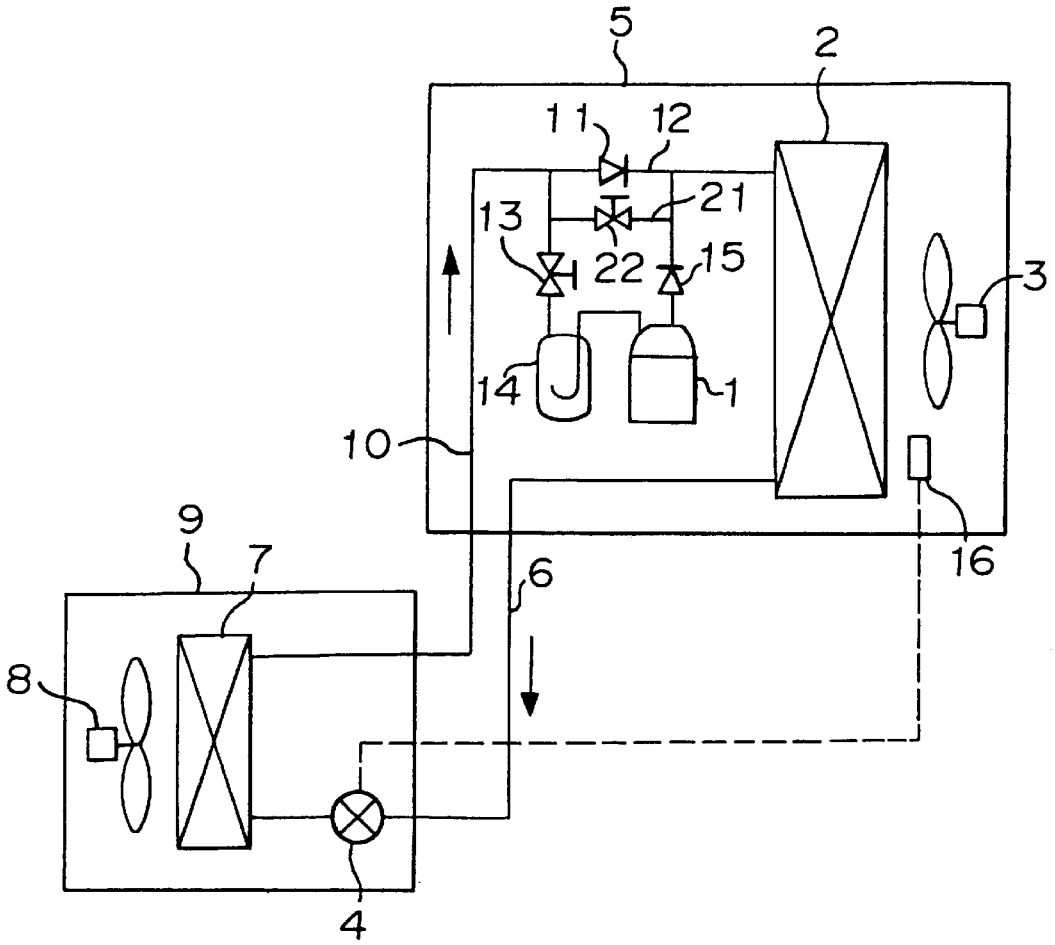
FIG. 13 is a circuit diagram showing the air conditioner according to the eighth embodiment of the present invention.

FIG. 13 is a circuit diagram of the air conditioner according to the eighth embodiment wherein the same reference numerals as in FIG. 1 designate the same or corresponding parts.

In FIG. 13, reference numeral 21 designates a second bypass pipe for connecting a high pressure pipe connected to an outlet portion of the compressor 1 with a low pressure pipe connected to an inlet portion of the accumulator 14. An on-off valve 22 as a switching means is interposed in the second bypass pipe 21. Numeral 4 designates a refrigerant flow controlling means such as an electronic expansion valve which conducts pressure reduction of the refrigerant of high temperature and high pressure passing through the liquid pipe 6 to form a wet vapor of two-phase state. In the eighth embodiment, the electronic expansion valve 4 is located at an indoor unit side having the evaporator 7 in order to absorb a difference in refrigerant quantity which is caused due to a difference in the length of liquid portion between the forced circulation operation and the natural circulation operation.

The air conditioner of the eighth embodiment comprises the outdoor unit 5, the indoor unit 9 and liquid pipe 6 and the gas pipe 10 which connect these units in the same manner as the first embodiment.

The outdoor unit 5 comprises the compressor 1 for compressing a refrigerant gas, the condenser 2 for liquefying the refrigerant gas, the outdoor fan 3 as a blower, to supply forcibly outer air to an outer surface of the condenser 2, the accumulator 14 as a refrigerant storing means which prevents the liquid from reversing to the compressor 1 in a case of a transient phenomenon or the supercharging of the refrigerant, the on-off valve 13 for bypassing the compressor 1 and the accumulator 14 in the natural circulation operation, the bypass pipe 12 including the check valve 11, the check valve 15 preventing the refrigerant from entering into the compressor in the natural circulation operation, and the second bypass pipe for connecting by interposing the on-off valve 22 the high pressure pipe connected to the outlet portion of the compressor 1 with the low pressure pipe connected to the inlet portion of the accumulator 14.

The indoor unit 9 comprises the electronic expansion valve 4 which reduces the pressure of the refrigerant liquid of high temperature and high pressure introduced through the liquid pipe 6 to be a wet vapor of two-phase state, the evaporator 7 for vaporizing the wet vapor throttled by the electronic expansion valve 4 depending on an air conditioning load and the indoor fan 8 as a blower provided at an indoor side.

In the forced circulation operation, the air conditioner of the eighth embodiment is so adapted that the degree of opening of the electronic expansion valve 4 is set to an appropriate degree of opening by which the refrigerant liquid discharged from the condenser 2 is subjected to pressure reduction to be a wet vapor having a two-phase state; the electromagnetic valve 13 at an inlet side of the accumulator is opened, and the compressor is operated. At this moment, the check valve 11 is closed by a pressure difference between a discharge pressure and an intake pressure of the compressor 1 to thereby form the refrigerant circuit for forced circulation.

Further, in the natural circulation operation, the degree of opening of the electronic expansion valve 14 is fully opened to reduce a pressure loss in the refrigerant circuit, and the electromagnetic valve 13 at an inlet side of the accumulator 14 is closed whereby the check valve 11 is opened according to the refrigerant flow and the refrigerant circuit for natural circulation is formed.

As described with respect to the first embodiment, when a refrigerant quantity wherein the air cooling ability in the natural circulation operation is the maximum is charged in the refrigerant circuit, there produces an excessive amount of refrigerant in the forced circulation operation and the excessive refrigerant is accumulated in the accumulator 14. Accordingly, when the operation is switched, it is necessary to conduct the refrigerant recovery operation for returning the excessive refrigerant to the refrigerant circuit for the natural circulation operation. As the refrigerant recovery operation, there is a way to entirely closing the degree of opening of the electronic expansion valve 4 for the forced circulation operation. In this method, however, an intake pressure of the compressor 1 is suddenly reduced whereby bubbles are formed in the refrigerant liquid sucked into the compressor 1 and a machine oil for refrigeration flows into the refrigerant circuit along with the discharge gas with the result that an amount of the machine oil inside the compressor 1 decreases to cause the burning due to a failure of lubrication. In particular, in a scroll type compressor, when an oil feeding rate to sliding portions is decreased due to a reduction of sucking pressure or the production of bubbles in the refrigerant liquid in the compressor 1, there cause the destruction due to the sliding portions thermally deformed by temperature rise.

Figure 14:
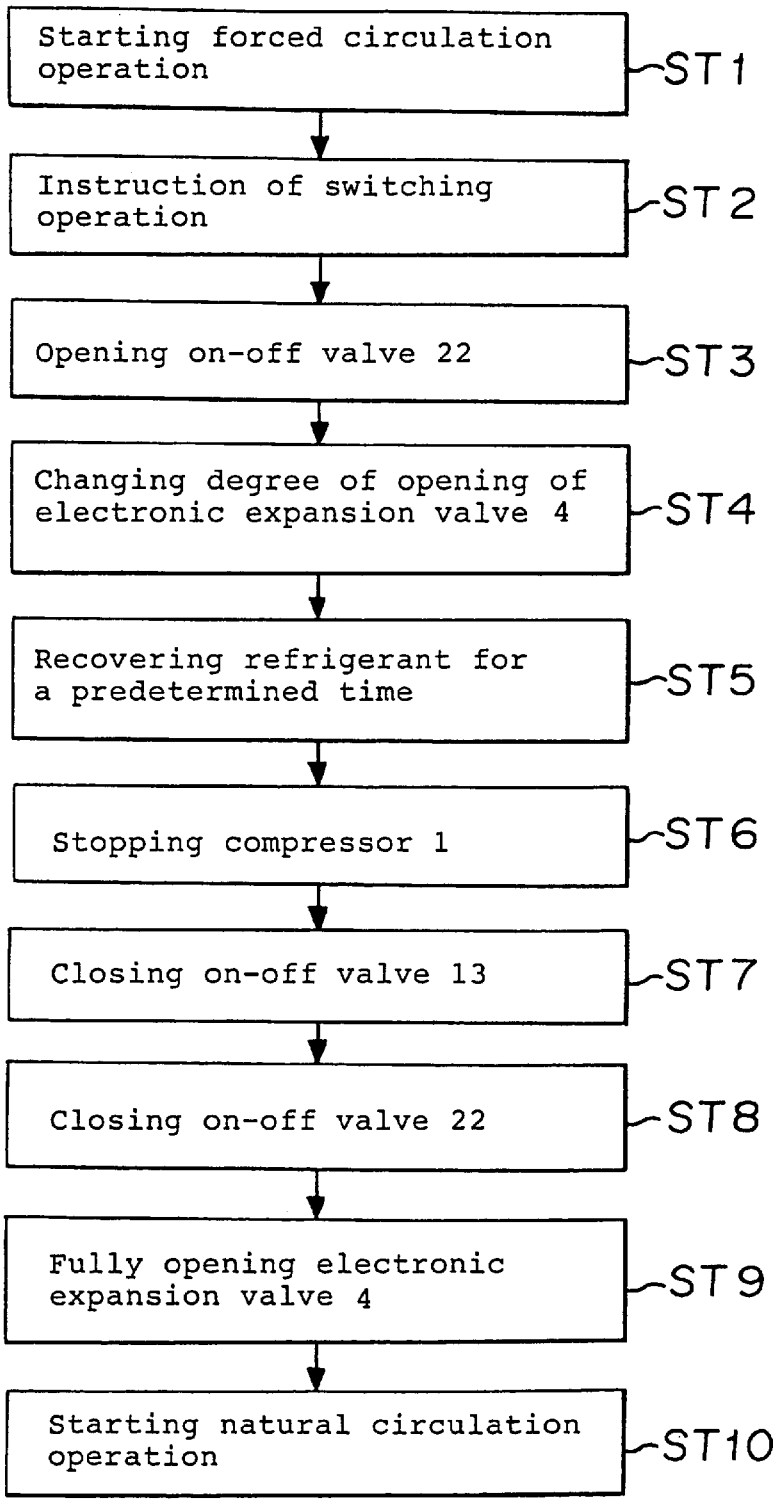
FIG. 14 is a flow chart showing a process for switching from a forced circulation operation to a natural circulation operation related to the eighth embodiment of the present invention.

FIG. 14 is a flow chart showing a process for switching the forced circulation operation to the natural circulation operation in the air conditioner according to the eighth embodiment. A refrigerant quantity necessary for the forced circulation operation is about half as much as a refrigerant quantity to be circulated in the natural circulation operation, and an excessive refrigerant is stored in the accumulator in the forced circulation operation. Accordingly, when the operation is switched from the forced circulation operation to the natural circulation operation, it is necessary to recover the refrigerant stored in the accumulator 14 to the refrigerant circuit for the natural circulation operation.

In Step ST1 for the forced circulation operation, the on-off valve 13 is opened; the on-off valve 22 is closed, and the degree of opening of the electronic expansion valve 4 is set to an appropriate degree of opening by which the pressure of the refrigerant liquid discharged from the condenser 2 is reduced so as to form a wet vapor having a two-phase state. At Step ST2, an instruction of switching of the operation is given and the refrigerant recovery operation is started.

Namely, the on-off valve 22 is opened at Step ST3, and the degree of opening of the electronic expansion valve 4 is throttled to a degree of opening whereby the refrigerant state in the outlet portion of the evaporator 7 becomes a state of superheating at Step ST4. In such state, the compressor 1 is actuated for a predetermined time such as about 2 minutes to conduct the refrigerant recovering operation at Step ST5.

When the degree of opening of the electronic expansion valve 4 is made smaller than the degree of opening in the forced circulation operation, the refrigerant flow rate is reduced so that the refrigerant state in the outlet portion of the evaporator 7 becomes a state of superheating. Then, the superheating gas from the evaporator 7 flows into the accumulator 14. With this, a part of the superheating gas of high temperature and high pressure discharged from the compressor 1 flows into the accumulator 14. The refrigerant liquid in the accumulator 14 is vaporized by the superheating gas from the evaporator 7 and the superheating gas discharged from the compressor 1 through the bypass pipe 21 via the on-off valve 22, and the vaporized refrigerant gas is recovered toward a side of the condenser 2.

Then, at Step ST6, the compressor 1 is stopped, and at Step ST7, the on-off valve 13 is closed to prevent the refrigerant from flowing into the accumulator 14. At Step ST8, the on-off valve 22 is closed. At Step ST9, the degree of opening of the electronic expansion valve 4 is opened, for example, fully opened in order to reduce a pressure loss in the refrigerant circuit. Then, at Step ST10, the operation is moved to the natural circulation operation.

As described above, in the refrigerant recovering operation at Step ST5 in the eighth embodiment, the bypass pipe 21 for connecting the inlet side and the outlet side of the compressor 1 and the on-off valve 22 are provided, and a part of the superheating gas of high temperature and high pressure discharged from the compressor 1 is bypassed to the intake side. Accordingly, the refrigerant stored in the accumulator 14 can smoothly be recovered to the refrigerant circuit for the natural circulation operation without reducing the pressure of the compressor 1.

In the eighth embodiment, an outdoor air temperature sensor 16 detects an outdoor air temperature, and a temperature difference between the detected outdoor air temperature and a set temperature for air conditioning is compared as shown in FIG. 13. Then, the degree of opening of the electronic expansion valve 4 is changed (Step ST4), or a refrigerant recovering time is changed (Step ST5) depending on the temperature difference obtained by the comparison whereby an evaporation amount of the excessive refrigerant stored in the accumulator 14 is changed as shown in FIG. 14. Namely, a refrigerant quantity to be recovered is changed in response to the temperature difference between the detected value of outdoor air temperature and a set temperature for air conditioning so that the refrigerant amount in the refrigerant circuit in the natural circulation operation is increased or decreased. As shown in FIG. 3, there exists the optimum amount of refrigerant by which the air conditioning ability can be utilized to the maximum, with respect to the temperature difference between an outdoor air temperature and an indoor air temperature in the natural circulation operation. Accordingly, by changing the refrigerant quantity depending on the temperature difference between the outdoor air temperature and the set temperature for air conditioning, it is possible to change the refrigerant quantity in the refrigerant circuit in the natural circulation operation while it is possible to obtain the maximum air conditioning ability at the outdoor air temperature.

In order to change the evaporation rate of the excessive refrigerant stored in the accumulator 14 depending on a temperature difference between a detected value of outdoor air temperature and the set temperature for air conditioning, the degree of opening of the electronic expansion valve 4 is changed to adjust the evaporation rate at Step ST4 in FIG. 14. Since it is preferable that the refrigerant quantity in the natural circulation operation is more when the temperature difference is large, the degree of opening of the electronic expansion valve 4 should be increased to increase the refrigerant flow rate. On the other hand, since the air conditioning ability can be increased with a smaller refrigerant quantity in the natural circulation operation when the temperature difference is small, the degree of opening of the electronic expansion valve 4 is reduced to reduce the refrigerant flow rate. In this case, the refrigerant recovery operation should be fixed to about 2 minutes.

Further, the evaporation rate can be changed by changing a time for the refrigerant recovery operation depending on a temperature difference at Step ST5. When the temperature difference is larger, the refrigerant recovery operation is made longer. On the other hand, when the difference is smaller, the refrigerant recovery operation should be shortened since a smaller refrigerant quantity in the natural circulation operation increases the air conditioning ability. In this case, the electronic expansion valve 4 is fixed to a certain degree of opening which is smaller than that in the forced circulation operation.

Further, the air conditioner may be so constructed that the refrigerant recovery operation is conducted until the discharge temperature and the intake temperature of the compressor 1, which are previously detected, reach set values, and the set values are changed depending on a temperature difference between an outdoor air temperature and the set temperature for air conditioning.

Further, the air conditioner may be so constructed that the refrigerant recovery operation is conducted until the degree of superheating in the outlet portion of the evaporator 7, which is previously detected, reaches a predetermined set value of superheating, e.g., 20° C. wherein the set value may be changed depending on a temperature difference between an outdoor air temperature and the set temperature for air conditioning.

The operating time, the degree of opening of the electronic expansion valve 4, the discharge temperature and the intake temperature of the compressor 1 and the set value of the degree of superheating in the outlet portion of the evaporator 7 used for the refrigerant recovery operation may be previously memorize by obtaining relations between parameters of them, the evaporation rate from the accumulator 14 and the refrigerant quantity remained therein in conducting experiments or simulation.

In this case, it is preferable that the operation for changing an excessive refrigerant to be recovered which is stored in the accumulator 14 depending on the temperature difference between the outdoor air temperature and the set temperature for air conditioning, is conducted under the temperature difference between the outdoor air temperature and the set temperature for air conditioning, for example, a temperature not less than 25° C. This is because of, as described with reference to FIG. 4, preventing reduction in reliability on communication devices disposed in the shelter due to an excessive air cooling ability which will cause excessively cooling the inside of the shelter. Namely, when the temperature difference between an outdoor air temperature and a set temperature for air conditioning is not less than 25° C. wherein for example, the set temperature is set to be 38° C., and if the outdoor air temperature is lower than about 13° C., the air conditioning load decreases to result the excessive air cooling ability.

As described above, the air conditioner according to the eighth embodiment can recover the refrigerant stored in the accumulator 14 to the refrigerant circuit during the natural circulation operation without reducing the intake pressure of the compressor 1 whereby reliability on the compressor can be improved.

Further, since the outdoor air temperature is detected and the time for the refrigerant recovering operation and the degree of opening of the electronic expansion valve 4 in the recovering operation are controlled, the refrigerant quantity can suitably be controlled depending on the temperature difference between the outdoor air temperature and the set temperature for air conditioning whereby the maximum cooling ability in the natural circulation operation can be provided. Accordingly, the refrigerant can smoothly be recovered without requiring a special heating means such as an electric heater, and effect for reducing consumption power as a characteristic feature of the natural circulation operation is sufficiently performed.

In the eighth embodiment, the electronic expansion valve 4 is disposed near the evaporator in the indoor unit. Accordingly, a difference of the refrigerant quantity due to a difference of the length of the liquid portion between the natural circulation operation and the forced circulation operation can be minimized. Namely, in the natural circulation operation and the forced circulation operation, when the distance between the electronic expansion valve 4 and the evaporator 7 is large, the difference of the liquid portion becomes large, whereas, when the distance is small, the difference becomes large whereby the difference in the length of the liquid portion can be made smaller. With such construction, the size of the accumulator 14 as a refrigerant storing means can be made smaller.

Embodiment 9

In the following, the ninth embodiment of the preset invention will be described with reference to FIG. 15, which shows a circuit diagram of the air conditioner, for example, an air conditioning apparatus according to the ninth embodiment. In this embodiment, the natural circulation operation and the forced circulation operation can be utilized. The structure of the ninth embodiment is the same as that of the first embodiment except that the electronic expansion valve 4 is disposed near the evaporator 7 in the indoor unit 9. The construction that the electronic expansion valve 4 is in the indoor unit 9 minimizes as possible a difference of refrigerant quantity due to a difference of the length of the liquid portion in the natural circulation operation and the forced circulation operation in the same manner as the eighth embodiment, whereby the accumulator 14 as a refrigerant storing means can be miniaturized.

In the following, description will be made mainly as to the refrigerant recovering operation conducted when the forced circulation operation is switched to the natural circulation operation.

In the forced circulation operation, the degree of opening of the electronic expansion valve 4 is set to have an appropriate degree of opening to reduce the pressure of the refrigerant liquid discharged from the condenser 2 so that the refrigerant liquid is formed to be a wet vapor in a two-phase state. The electromagnetic valve 13 at an inlet side of the accumulator 14 is opened, and the compressor 1 is started. At this moment, the check valve 11 is closed due to the pressure difference between the discharge pressure and the intake pressure of the compressor 1, thus, the refrigerant circuit for the forced circulation operation is formed.

In the natural circulation operation, the compressor 1 is stopped; the electromagnetic valve 13 at the inlet side of the accumulator 14 is closed, and the degree of opening of the electronic expansion valve 4 is fully opened so as to reduce a pressure loss in the refrigerant circuit. At this moment, the check valve 11 is opened by the flow of the refrigerant, thus, the refrigerant circuit for the natural circulation operation is formed.

Figure 16:
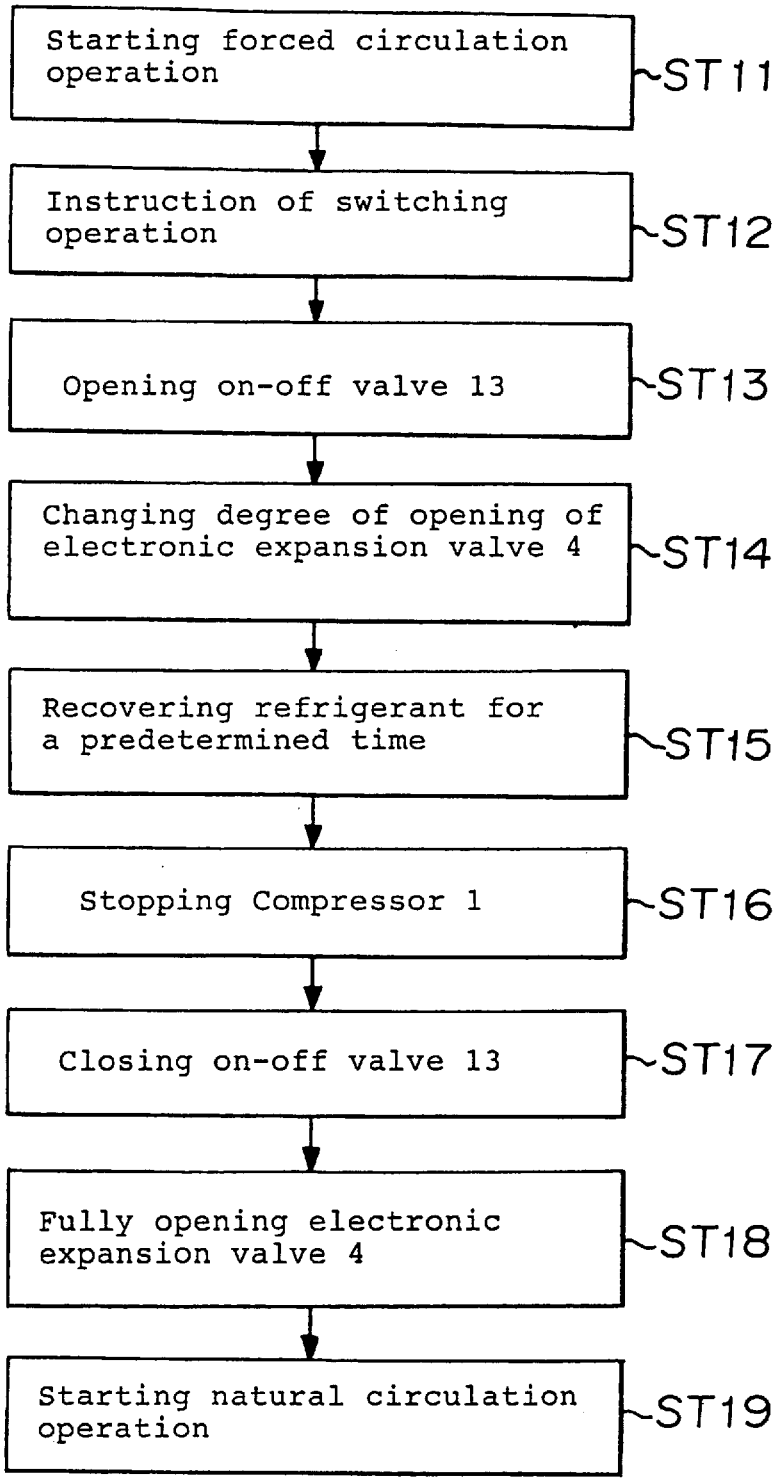
FIG. 16 is a flow chart showing a process for switching from a forced circulation operation to a natural circulation operation related to the ninth embodiment of the present invention.
Figure 17:
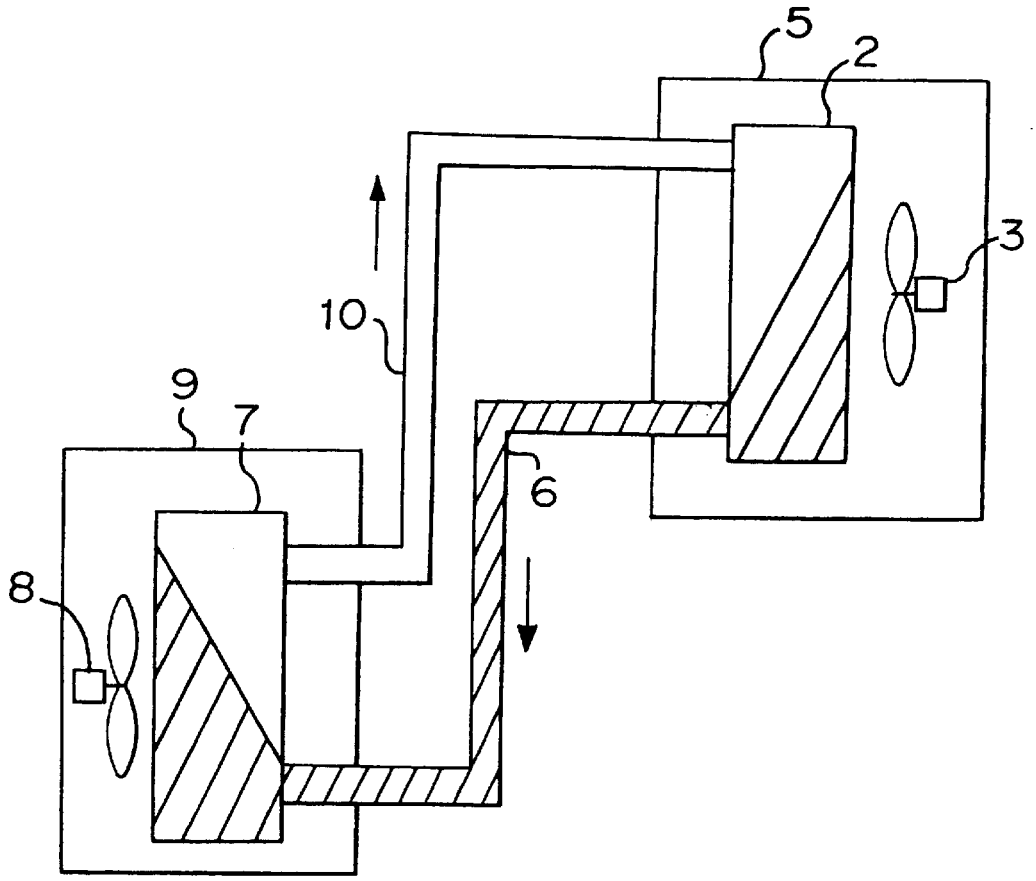
FIG. 17 is a diagram showing the basic circuit of a conventional air conditioner utilizing a natural circulation operation.
Figure 18:
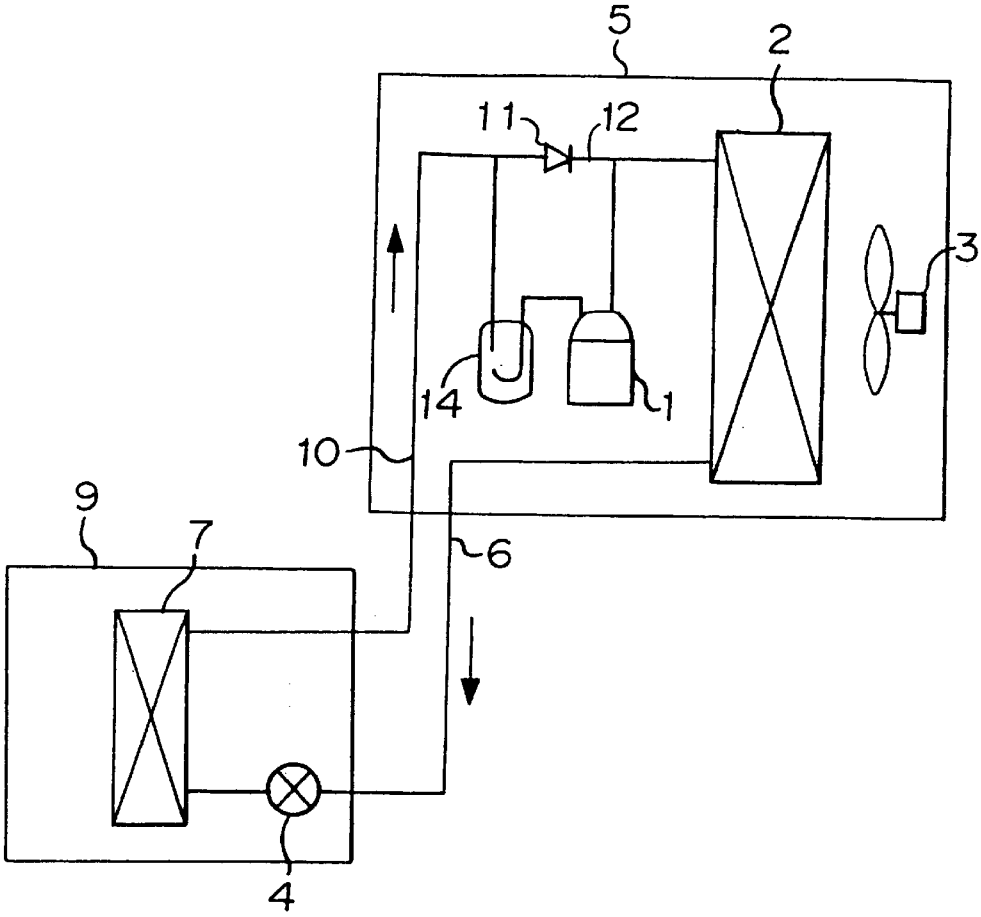
FIG. 18 is a diagram showing the circuit of the air conditioner according to the Conventional Example 1 with a natural circulation operation and a forced circulation operation.
Figure 19:
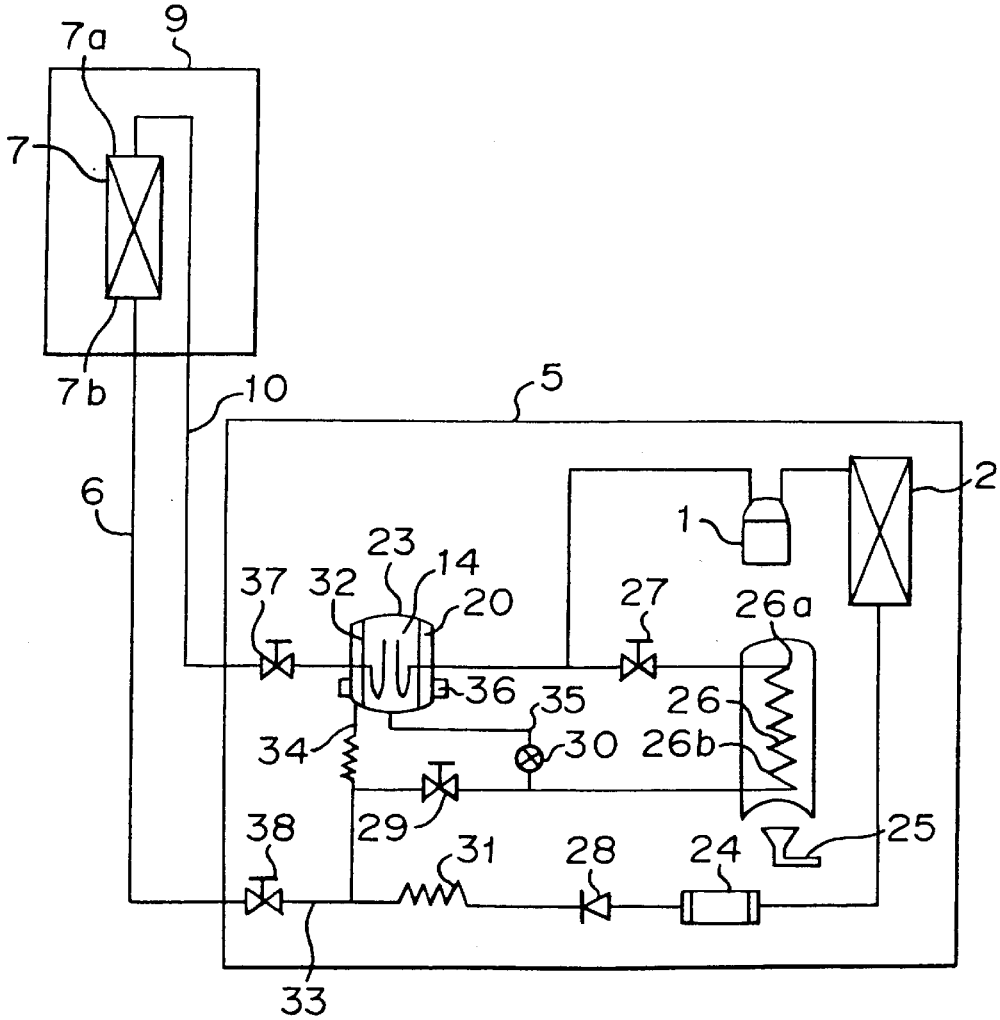
FIG. 19 is a diagram showing the circuit of the air conditioner according to the Conventional Example 2 with a natural circulation operation and a forced circulation operation.

FIG. 16 is a flow chart showing a process for switching from the forced circulation operation to the natural circulation operation in the air conditioner of the ninth embodiment. The refrigerant quantity required for the forced circulation operation is about ½ as much as the refrigerant quantity circulated in the natural circulation operation, and an excessive refrigerant is gradually stored in the accumulator 14 during the forced circulation operation. In switching the operation from the forced circulation operation to the natural circulation operation, it is necessary to recover the refrigerant stored in the accumulator 14 to the refrigerant circuit for the natural circulation operation. In the ninth embodiment, it is assumed that the refrigerant stored in the accumulator 14 is all recovered to the refrigerant circuit for the natural circulation operation.

First, at Step ST11, the forced circulation operation is started. At Step ST12, an operation switching instruction is received. At Step ST13, the on-off valve 13 is opened to start the refrigerant recover operation under such condition that the degree of opening of the electronic expansion valve 4 is in a proper degree of opening so that the pressure of the refrigerant liquid discharge from the condenser 2 is reduced to render it to be a wet vapor of two-phase state. Namely, at Step ST14, the degree of opening of the electronic expansion valve 4 is throttled to such a degree that the refrigerant state in the outlet portion of the evaporator 7 to be in a state of superheating. Specifically, the degree of opening of the electronic expansion valve 4 is made smaller or fully closed from the degree of opening for the forced circulation operation so that the refrigerant flow rate is made smaller or 0. Then, at Step ST15, the refrigerant recover operation is conducted by actuating the compressor 1 for a predetermined time, e.g., about 2 minutes. Since the refrigerant flow rate is made smaller or 0 at this moment, the refrigerant state in the outlet portion of the evaporator 7 becomes a superheat state, and the superheat gas flows into the accumulator 14. The refrigerant liquid in the accumulator 14 is vaporized by the superheat gas and the vapor is recovered towards a condenser side.

Then, at Step ST16, the compressor 1 is stopped. At Step ST17, the on-off valve 13 is closed to prevent the refrigerant from entering into the accumulator 14. At Step ST18, the degree of opening of the electronic expansion valve is, for example, fully opened to reduce a pressure loss in the refrigerant circuit. Then, at step ST 19, the operation is moved to the natural circulation operation.

In the ninth embodiment, the refrigerant state in the outlet portion of the evaporator 7 is in a superheat state, and the refrigerant in the accumulator 14 is vaporized by the superheat gas thus resulted. Accordingly, the effect of reducing consumption power as a characteristic feature of the natural circulation operation is obtainable without requiring a special heating means such as electric heater to the accumulator 14. Further, the forced circulation operation can be switched smoothly to the natural circulation operation according to a simple procedure.

As described above, in order to render the refrigerant state in the outlet portion of the evaporator 7 to be a state of superheating and to vaporize the refrigerant in the accumulator 14 by the superheat gas obtained, the degree of opening of the electronic expansion valve 4 is made smaller or fully closed from the degree of opening in the forced circulation operation to throttle the refrigerant flow rate to be smaller or 0, and the compressor 1 is started for a predetermined time in this state. In the refrigerant recovering operation according to the ninth embodiment, a time necessary for evaporating entirely the excessive refrigerant stored in the accumulator 14 is previously determined so that the refrigerant recovering operation is finished when the excessive refrigerant is entirely vaporized. The determination of operating time permits easy judgement of the completion of the refrigerant recovery operation.

Further, for the judgement of the completion of the refrigerant recovering operation, the following technique may be utilized. A temperature sensor and a pressure sensor are provided to detect a degree of superheating at an outlet side and a degree of superheating at an intake side of the compressor 1; the degree of opening of the electronic expansion valve 4 is made smaller or fully closed from the degree of opening in the forced circulation operation to throttle the refrigerant flow rate to be smaller or 0; and the compressor 1 is operated until values detected on degrees of superheating at the outlet and inlet sides reach predetermined set values.

Further, the completion of the refrigerant recovering operation can be detected by providing a temperature sensor for detecting temperatures at a discharge side and an intake side of the compressor 1, and by detecting a rate of temperature rise based on the temperatures detected by the temperature sensor. There is no substantial increase of the temperatures at the discharge side and the intake side of the compressor 1 when the refrigerant liquid flows at the outlet side of the accumulator 4. However, when the degree of opening of the electronic expansion valve 4 is made small whereby the degree of superheating of the refrigerant in the accumulator 14 is increased and a refrigerant gas follows through an intake portion and a discharge portion of the compressor 1, the rate of temperature rise at these portions is increased. For this, the refrigerant recovering operation may be deemed to be completed when the rate of temperature rise in the intake portion or the discharge portion of the compressor 1 reaches a predetermined set value, for example, exceeds 5° C./min.

Further, the completion of the refrigerant recovering operation may be determined in such a case that a relation between the state of superheating in the outlet portion of the evaporator 7 and temperatures of discharge and intake sides of the compressor 1 is previously obtained, and the recovering operation is finished when the temperature of discharge side and/or the temperature of intake side reaches a predetermined set value.

Further, the completion of the refrigerant recovering operation may be determined such that a detector for detecting the degree of superheating in the outlet portion of the evaporator 7 is disposed; the degree of opening of the electronic expansion valve 4 is made smaller or fully closed from the degree of opening in the forced circulation operation to throttle the refrigerant flow rate to be smaller or 0; and the compressor 1 is operated until the detected degree of superheating reaches the set value. In this case also, the completion of the refrigerant recovering operation can be detected. The technique of detecting the degree of superheating is omitted since it has been described in the second embodiment.

In order to detect the completion of the refrigerant recovering operation, it is necessary to previously determine set values for the operating time, the discharge temperature, the intake temperature and the degree of superheating under the condition that the degree of opening of the electronic expansion valve 4 is made smaller or entirely closed from the degree of opening in the forced circulation operation whereby the refrigerant flow rate is made smaller or made entirely 0. As an example of the method for the determination, experiments or simulation should be conducted so as to obtain a relation between the degree of opening of the electronic expansion valve 4 and the operating time necessary for vaporizing refrigerant when a ½ amount of refrigerant based on the total amount is stored in the accumulator 14, and values of the temperatures at the outlet and inlet sides of the compressor 1 and values of degree of superheating at the outlet of the evaporator 7 at the time when there remains no substantial amount of refrigerant in the accumulator 14.

Figure 15:
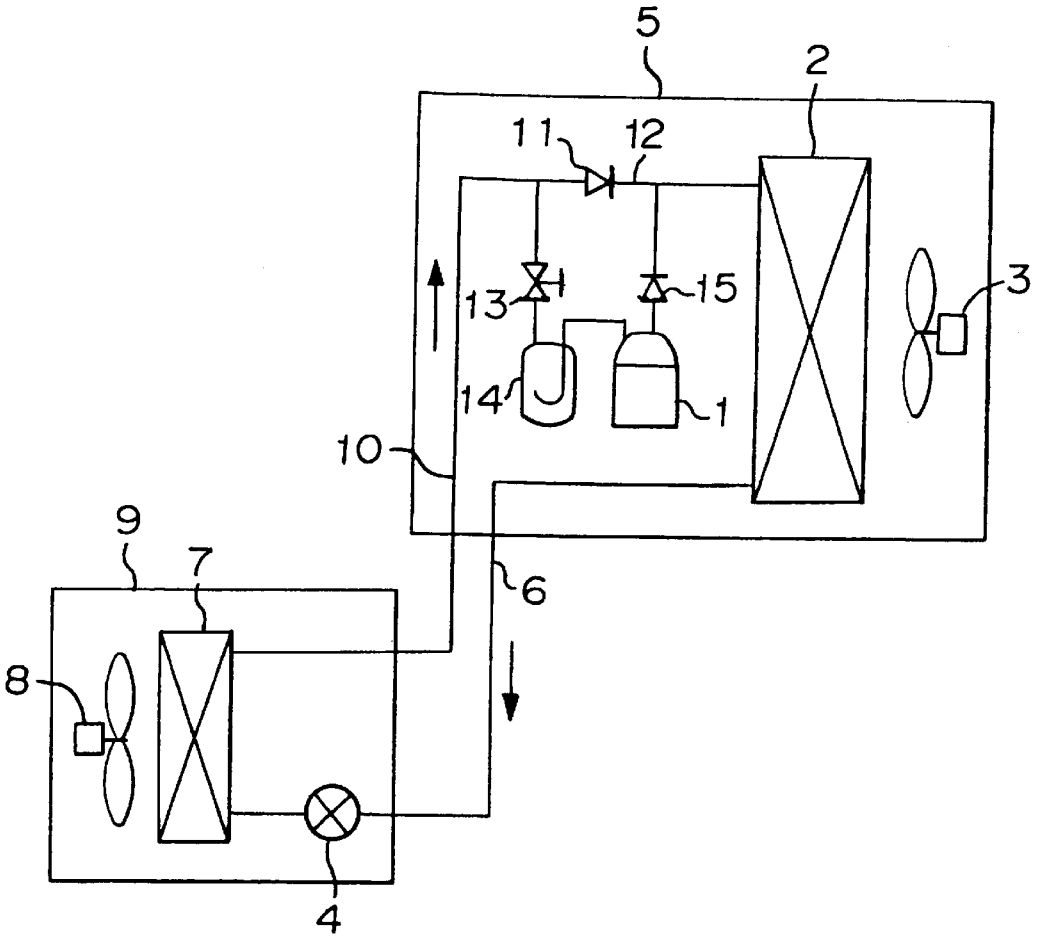
FIG. 15 is a circuit diagram showing the air conditioner according to a ninth embodiment of the present invention.

In the construction as shown in FIG. 15, when the second bypass pipe 21 connecting the inlet side and the outlet side of the compressor 1 and the on-off valve 22 are provided so that a part of the superheated gas of high temperature and high pressure discharged from the compressor 1 is introduced along with the superheated gas from the evaporator 7 into the accumulator 14, as described in the eighth embodiment, the refrigerant stored in the accumulator 14 can smoothly be recovered to the refrigerant circuit for the natural circulation without causing a reduction of pressure in the compressor 1.

In the above-mentioned embodiments 1 to 9, the electronic expansion valve is used as the refrigerant flow controlling means 4. However, the present invention is not limited thereto. In particular, the refrigerant flow controlling means 4 in the second, sixth, seventh and eighth embodiment may be such one capable of changing the refrigerant flow rate by receiving a control signal from the superheating degree operating/controlling means 19 or the supercooling operating/controlling means 18 during the operation of the air conditioner. For example, a combination of a plurality of capillary pipes and a plurality of different kinds of on-off valves may be used. In this case, the number of capillary pipes through which the refrigerant is passed can be changed depending on the kinds of the on-off valves operated in response to the control signal.

In the above-mentioned third embodiment, the velocity of the indoor fan 8 or the outdoor fan 3 as means for changing the air flow rate to the evaporator 7 or the condenser 2, is changed. However, this is not in particular limited. For example, the shape of an air flow path can be changed to change an air flow resistance instead of changing the velocity. Further, the velocity may be changed along with the shape of an air flow path.

In the air conditioner according to the first to ninth embodiments, the refrigerant used may be flon R22, flon R410A having flon R32/R125 of a ratio of 50/50 wt % as a refrigerant mixture, flon R407C having flon R32/R125/R134*a* of a ratio of 23/25/52 wt %, a refrigerant mixture contains hydrocarbon or hydrocarbon refrigerant, ammonia or the like.

When flon R410A (R32/R125=50/50 wt %) is used as the refrigerant, a pressure loss in the refrigerant circuit is smaller than R22, and the air cooling ability in the natural circulation operation can be increased.

Further, the hydrocarbon refrigerant may be propane (R290) or isobutane (R600*a*) for example. These are known as refrigerant wherein the ozone layer destruction performance (ODP) is 0; the earth warming performance (GWP) is smaller by a unit of 1 order of more than that of the refrigerant such as flon R22 or flon R410A, and are more harmless to global environments. In particular, propane (R290) as the hydrocarbon refrigerant is about 2.3 times in terms of evaporation heat transmission coefficient and about 1.3 times in terms of condensation heat transmission coefficient than flon R22 having the same mass velocity. Further, it is preferable from the viewpoint of the pressure loss, and it is more harmless to global environments and provides the performance similar to flon R22.

As described above, description is made so that propane (R290) as the hydrocarbon refrigerant is suitable for the natural circulation operation. However, another hydrocarbon refrigerant or refrigerant mixture including hydrocarbon having a large thermal transmission coefficient and small power loss may be utilized as the refrigerant for the natural circulation operation while it is more harmless to global environments. Specifically, the refrigerant mixture including hydrocarbon refrigerant may be carbon dioxide ($CO_2$)/propane (R290) or ammonia ($NH_3$)/propane (R290) for example.

Further, in the first to ninth embodiments, the air cooling apparatus is explained as the air conditioner. However, the present invention is applicable to a warming apparatus provided with a condenser at an indoor side and an evaporator at an outdoor side wherein an outdoor warm heat is utilized to perform the same effect.

Obviously, numerous modifications and variations of the present invention are possible in light of the above teachings. It is therefore to be understood that within the scope of the appended claims, the invention may be practiced otherwise than as specifically described herein.

What is claimed is:

1. In a method for determining a charging amount of refrigerant for an air conditioner which conducts a natural circulation operation by circulating refrigerant through an evaporator and a condenser located at a higher position than the evaporator, which are connected with pipes, said method being characterized by comprising means for obtaining an air conditioning load quantity to an outdoor air temperature among outdoor air temperatures, means for obtaining an air conditioning ability quantity to an outdoor air temperature in a temperature range in a case of using a predetermined amount of refrigerant, means for obtaining the maximum outdoor air temperature capable of conducting air conditioning at the time when an air conditioning load quantity produced from the means for obtaining an air conditioning load quantity substantially coincides with an air conditioning ability quantity from the means for obtaining an air conditioning ability quantity in using a predetermined amount of refrigerant, and means for obtaining respective maximum outdoor air temperatures capable of conducting air conditioning when said predetermined amount of refrigerant is changed and for determining an amount of refrigerant, as an-amount to be charged, in which a maximum outdoor air temperature capable of conducting air conditioning among the obtained maximum outdoor air temperatures becomes the maximum.

2. In a method for controlling refrigerant for an air conditioner capable of switching between a forced circulation operation for circulating refrigerant through a compressor, a condenser, a refrigerant flow controlling means, an evaporator and a refrigerant storing means which are connected successively with pipes and a natural circulation operation for circulating the refrigerant through a bypass pipe for bypassing the compressor and the refrigerant storing means, the condenser, the refrigerant flow controlling means and the evaporator which are connected, said method being characterized by comprising , at the time of switching from the forced circulation operation to the natural circulation operation, means for making the refrigerant in an outlet portion of the evaporator to be a superheat state, and means for introducing a refrigerant gas in a superheat state into the refrigerant storing means to vaporize the refrigerant stored in the refrigerant storing means whereby the refrigerant stored in the refrigerant storing means during the forced circulation operation is recovered into a refrigerant circuit for the natural circulation operation.

3. The method for controlling refrigerant for an air conditioner according to claim 2, wherein the refrigerant flow controlling means is controlled by said means for making the refrigerant in the outlet portion of the evaporator to be an overheated state so that the refrigerant flow rate is smaller than a refrigerant flow rate in the forced circulation operation.

4. The method for controlling refrigerant for an air conditioner according to claim 2, wherein a part of a superheated gas discharged from the compressor is introduced into the refrigerant storing means along with the superheated gas from the evaporator by means of a refrigerant vaporizing means on the refrigerant stored in the refrigerant storing means whereby the refrigerant stored in the refrigerant storing means is vaporized.

5. The method for controlling refrigerant for an air conditioner according to claim 4, wherein the refrigerant vaporizing means is operated for a predetermined time to vaporize the refrigerant stored in the refrigerant storing means.

6. The method for controlling refrigerant for an air conditioner according to claim 2, wherein the refrigerant vaporizing means is operated on the refrigerant stored in the refrigerant storing means so that a degree of superheating in the outlet portion of the evaporator reaches a predetermined degree of superheating.

7. The method for controlling refrigerant for an air conditioner according to claim 2, wherein in the natural circulation operation, at least one of a refrigerant flow rate, an air flow rate to the evaporator and a refrigerant quantity in the evaporator is changed so that a degree of superheating or a degree of dryness of the refrigerant in the outlet portion of the evaporator becomes a predetermined value.

8. The method for controlling refrigerant for an air conditioner according to claim 7, wherein values to be set for the refrigerant in the outlet portion of the evaporator in the natural circulation operation are a value of not less than 0.9 in terms of a degree of dryness and a value of not more than 10° C. in terms of a degree of superheating.

9. The method for controlling refrigerant for an air conditioner according to claim 7, wherein at least one of the refrigerant flow rate, the air flow rate to the condenser and the refrigerant quantity in the condenser is changed so that a degree of supercooling or a degree of dryness of the refrigerant in the outlet portion of the condenser in the natural circulation operation becomes a predetermined value.

10. The method for controlling refrigerant for an air conditioner according to claim 9, wherein values of the refrigerant in the outlet portion of the condenser in the natural circulation operation are not more than 0.1 in terms of a degree of dryness and not more than 20° C. in terms of a degree of supercooling.

11. The method for-controlling refrigerant for an air conditioner according to claim 7, wherein at least one of the refrigerant flow rate, the air flow rate and the refrigerant quantity in the natural circulation operation is changed with predetermined time intervals.

12. In a method for controlling refrigerant for an air conditioner capable of switching between a forced circulation operation for circulating refrigerant through a compressor, a condenser, a refrigerant flow controlling means, an evaporator and a refrigerant storing means which are connected successively with pipes and a natural circulation operation for circulating the refrigerant through a bypass pipe for bypassing the compressor and the refrigerant storing means, the condenser, the refrigerant flow controlling means and the evaporator which are connected, said method being characterized by comprising, at the time of switching from the forced circulation operation to the natural circulation operation, a refrigerant vaporizing means for vaporizing the refrigerant stored in the refrigerant storing means, means for detecting a temperature difference between an outdoor temperature and a set temperature set for air conditioning, and means for changing an evaporation quantity on the refrigerant depending on the magnitude of a temperature difference detected by the temperature difference detecting means when the refrigerant stored is vaporized by the refrigerant vaporizing means, whereby an amount of recovery of the refrigerant stored in the refrigerant storing means in the forced circulation operation is increased or decreased as a result that a refrigerant quantity in the refrigerant circuit in the natural circulation operation is increased or decreased.

13. The method for controlling refrigerant for an air conditioner according to claim 12, wherein a part of a superheated gas discharged from the compressor is introduced into the refrigerant storing means along with the superheated gas from the evaporator by means of the refrigerant vaporizing means on the refrigerant stored in the refrigerant storing means so that the refrigerant stored in the refrigerant storing means is vaporized.

14. The method for controlling refrigerant for an air conditioner according to claim 12, wherein the refrigerant vaporizing means is operated for a predetermined time.

15. The method for controlling refrigerant for an air conditioner according to claim 12, wherein the refrigerant vaporizing means is operated on the refrigerant stored in the refrigerant storing means until the degree of superheating of the refrigerant in the outlet portion of the evaporator becomes a predetermined value of superheating.

16. In an air conditioner comprising an evaporator and a condenser located at a higher position than the evaporator, which is connected to the evaporator with a pipe to conduct a natural circulation operation by circulating refrigerant, said air conditioner being characterized by comprising a refrigerant state detecting means for detecting a state of the refrigerant in an outlet portion of the evaporator in the natural circulation operation, a refrigerant flow controlling means for controlling a refrigerant flow rate in circulation and a controlling means for controlling the refrigerant flow controlling means depending on a state of the refrigerant detected by the refrigerant state detecting means to change the refrigerant flow rate.

17. The air conditioner according to claim 16, which further comprises a refrigerant storing means for storing an excessive amount of the refrigerant resulted from the controlling of the refrigerant flow rate.

18. The air conditioner according to claim 16, wherein the refrigerant state detecting means is to detect a degree of superheating or a degree of dryness of the refrigerant in the outlet portion of the evaporator.

19. The air conditioner according to claim 16, wherein the refrigerant state detecting means is to detect a degree of supercooling or a degree of dryness of the refrigerant in the outlet portion of the condenser, and the controlling means is to operate the refrigerant flow controlling means to change the refrigerant flow rate depending on a temperature difference between an outdoor air temperature and a set temperature set for air conditioning and a-state of the refrigerant.

20. In an air conditioner capable of switching between a forced circulation operation for circulating refrigerant through a compressor, a condenser, a refrigerant flow controlling means, an evaporator and a refrigerant storing means which are connected successively with pipes and a natural circulation operation for circulating the refrigerant through a bypass pipe for bypassing the compressor, the condenser located at a higher position than the evaporator, the refrigerant flow controlling means and the evaporator which are connected, said air conditioner being characterized in that the refrigerant flow controlling means is located in a space where the evaporator is located.

* * * * *

UNITED STATES PATENT AND TRADEMARK OFFICE

CERTIFICATE OF CORRECTION

PATENT NO. : 6,220,041 B1
DATED : April 24, 2001
INVENTOR(S) : Takashi Okazaki et al.

It is certified that error appears in the above-identified patent and that said Letters Patent is hereby corrected as shown below:

Columns 41 - 44,
Delete claims 2-20.

Signed and Sealed this

Fifteenth Day of April, 2003

JAMES E. ROGAN
*Director of the United States Patent and Trademark Office*